US009778598B2

(12) United States Patent
Onozaki et al.

(10) Patent No.: US 9,778,598 B2
(45) Date of Patent: Oct. 3, 2017

(54) MAGNETIC CARRIER

(71) Applicant: CANON KABUSHIKI KAISHA, Tokyo (JP)

(72) Inventors: Yuto Onozaki, Saitama (JP); Nobuyoshi Sugahara, Tokyo (JP); Hironori Minagawa, Moriya (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/248,375

(22) Filed: Aug. 26, 2016

(65) Prior Publication Data

US 2016/0363889 A1 Dec. 15, 2016

Related U.S. Application Data

(63) Continuation of application No. PCT/JP2016/001854, filed on Mar. 30, 2016.

(51) Int. Cl.

| | |
|---|---|
| ***G03G 9/00*** | (2006.01) |
| ***G03G 15/09*** | (2006.01) |
| ***G03G 9/107*** | (2006.01) |
| ***G03G 9/113*** | (2006.01) |

(52) U.S. Cl.

CPC ..... *G03G 15/0928* (2013.01); *G03G 9/107* (2013.01); *G03G 9/1075* (2013.01); *G03G 9/113* (2013.01); *G03G 9/1131* (2013.01); *G03G 9/1139* (2013.01)

(58) Field of Classification Search

CPC ..... G03G 15/0928; G03G 9/1139; G03G 9/1131; G03G 9/1075; G03G 9/107; G03G 9/113

See application file for complete search history.

(56) References Cited

U.S. PATENT DOCUMENTS

| | | | |
|---|---|---|---|
| 5,437,949 | A | 8/1995 | Kanbayashi et al. |
| 5,607,806 | A | 3/1997 | Kanbayashi et al. |
| 5,635,326 | A | 6/1997 | Kanbayashi et al. |
| 5,670,288 | A | 9/1997 | Okado et al. |
| 5,700,617 | A | 12/1997 | Takiguchi et al. |
| 5,747,209 | A | 5/1998 | Takiguchi et al. |
| 5,851,714 | A | 12/1998 | Taya et al. |
| 5,912,099 | A | 6/1999 | Kanbayashi et al. |
| 5,922,500 | A | 7/1999 | Iida et al. |
| 5,994,018 | A | 11/1999 | Iida et al. |
| 6,013,402 | A | 1/2000 | Kanbayashi et al. |
| 6,022,659 | A | 2/2000 | Kanbayashi et al. |
| 6,077,635 | A | 6/2000 | Okado et al. |
| 6,326,114 | B1 | 12/2001 | Itakura et al. |
| 6,528,222 | B2 | 3/2003 | Kohtaki et al. |
| 6,586,147 | B2 | 7/2003 | Iida et al. |
| 6,664,016 | B2 | 12/2003 | Kanbayashi et al. |
| 6,751,424 | B2 | 6/2004 | Komatsu et al. |
| 6,808,852 | B2 | 10/2004 | Hotta et al. |
| 6,929,894 | B2 | 8/2005 | Sugahara et al. |
| 7,115,349 | B2 | 10/2006 | Iida et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,396,626 | B2 | 7/2008 | Fujikawa et al. |
| 7,396,629 | B2 | 7/2008 | Baba et al. |
| 7,442,478 | B2 | 10/2008 | Itakura et al. |
| 7,455,947 | B2 | 11/2008 | Ida et al. |
| 7,536,132 | B2 | 5/2009 | Minagawa |
| 7,816,063 | B2 | 10/2010 | Hashimoto et al. |
| 9,075,328 | B2 | 7/2015 | Minagawa et al. |
| 9,158,217 | B2 | 10/2015 | Takahashi et al. |
| 9,372,420 | B2 | 6/2016 | Mizo et al. |
| 9,454,094 | B2 | 9/2016 | Tsujimoto et al. |
| 9,500,975 | B2 | 11/2016 | Sugahara et al. |
| 2002/0006570 | A1 | 1/2002 | Kayamoto et al. |
| 2006/0246369 | A1 | 11/2006 | Pattison et al. |
| 2014/0096409 | A1 | 4/2014 | Ohtsu et al. |
| 2014/0101966 | A1 | 4/2014 | Minagawa et al. |
| 2014/0137428 | A1 | 5/2014 | Takenaka et al. |
| 2015/0017581 | A1 | 1/2015 | Tsuchida et al. |
| 2015/0268577 | A1 | 9/2015 | Takahashi et al. |
| 2016/0062257 | A1 | 3/2016 | Sugahara et al. |
| 2016/0306301 | A1 | 10/2016 | Sugahara et al. |

FOREIGN PATENT DOCUMENTS

| | | |
|---|---|---|
| JP | H03-111859 | 5/1991 |
| JP | 2001-272827 | 10/2001 |
| JP | 2004-333931 | 11/2004 |
| JP | 2005-049478 | 2/2005 |
| JP | 2007-121911 | 5/2007 |
| JP | 2008-070662 | 3/2008 |
| JP | 2009-192959 | 8/2009 |
| JP | 2009-217059 | 9/2009 |
| JP | 2009-229907 | 10/2009 |

OTHER PUBLICATIONS

U.S. Appl. No. 15/241,317, Nobuyoshi Sugahara, filed Aug. 19, 2016.

*Primary Examiner* — Thorl Chea

(74) *Attorney, Agent, or Firm* — Fitzpatrick Cella Harper and Scinto

(57) ABSTRACT

Provided is a magnetic carrier, including: a ferrite core particle; and a coating resin, in which: the coating resin has a surface resin layer and a resin composition in the stated order from a surface side thereof; the resin composition contains a resin, and an inorganic particle or carbon black that is subjected to a hydrophilic treatment; the surface resin layer contains a resin, is free of the inorganic particle or the carbon black, and has a thickness of from 0.01 μm or more to 4.00 μm or less; and a moisture percentage change between a moisture percentage when the magnetic carrier is left to stand under an environment of 30° C. and 80% RH for 24 hours, and a moisture percentage when the magnetic carrier is left to stand under an environment of 23° C. and 5% RH for 24 hours after the standing is 0.030 mass % or less.

3 Claims, 2 Drawing Sheets

MAGNETIC CARRIER

CROSS-REFERENCE TO RELATED APPLICATIONS

This application is a continuation of International Application No. PCT/JP2016/001.854, filed Mar. 30, 2016, which claims the benefit of Japanese Patent Application No. 2015-070601, filed Mar. 31, 2015.

BACKGROUND OF THE INVENTION

Field of the Invention

The present invention relates to a magnetic carrier to be used in an image-forming method including the step of developing (visualizing) an electrostatic latent image (electrostatic image) through use of an electrophotographic method.

Description of the Related Art

Higher speed and higher reliability of a copying apparatus or a printer have been strictly sought in recent years. Meanwhile, the copying apparatus and the printer have started to be constructed of simpler components in various respects. As a result, performance demanded for a developer has become more sophisticated. Accordingly, unless art improvement in the performance of the developer can be achieved, a more excellent copying apparatus and a more excellent printer do not become viable nowadays.

Of the methods each involving developing an electrostatic latent image formed on an electrostatic latent image-bearing member with a toner, a two-component developing method involving using a two-component developer obtained by mixing the toner with a magnetic carrier has been suitably employed in a full-color copying machine or printer required to provide high image quality. In the two-component developing method, the magnetic carrier provides the toner with a proper quantity of positive or negative charge through triboelectric charging, and the magnetic carrier carries the toner on its surface by means of the electrostatic attraction of the triboelectric charging.

Although various characteristics are demanded for the magnetic carrier and the toner constituting the two-component developer, characteristics particularly important for the magnetic carrier are, for example, proper charge-providing ability, resistance against an alternating voltage, impact resistance, wear resistance, resistance against spent toner, and developing ability.

The magnetic carrier has characteristics, such as powder characteristics, electrical characteristics, and magnetic characteristics, and is required to have each performance to fit with a developing system. In recent years, a magnetic carrier obtained by coating a core material (core) with a coating resin (coating material) has been widely used for improvements in environmental stability and durability.

For example, a magnetic carrier having at least two coating resin layers is used in each of the two-component developers of the following patent literatures.

In Japanese Patent Application Laid-Open No. 2005-49478, there is a disclosure of the following magnetic carrier. The resin of the outermost surface layer of the carrier contains a condensate of an N-alkoxyalkylated polyamide and a silicone resin, and the carrier has an intermediate layer containing a resin containing fine particles between the resin of the outermost surface layer and a core. Thus, charging stability under long-term use and the wear resistance of a coating film are improved, and hence the durability of the two-component developer is improved.

In addition, in Japanese Patent Application Laid-Open No. 2004-333931, there is a disclosure of a magnetic carrier that provides a toner image excellent in fine-line reproducibility through an improvement in film quality of a resin layer by the incorporation of ferrite particles subjected to a lipophilic treatment into the undermost layer of a coating resin.

In addition, in Japanese Patent Application Laid-Open No. 2008-70662, there is a disclosure of a carrier that expresses the following effect through the incorporation of alumina fine particles subjected to a hydrophobic treatment into a first coating resin layer coating the outer periphery of a core material. Spent components on the surface of the carriers are mutually shaved off by the carriers. As a result, a coating resin that has not received any stress is always exposed to the surface, and hence the performance of the carrier is retained and excellent life stability is achieved.

In addition, in Japanese Patent Application Laid-Open No. 2007-121911, there is a disclosure of a carrier including an inner resin coating layer with which the surface of a core particle is coated and an oater resin coating layer with which the surface of the inner resin coating layer is coated, the inner resin coating layer containing nonmagnetic fine particles whose surfaces are coated with fatty acid metal fine particles. As a result, even in the case of development over a long time period, an increase in van der Waals force between the core particle and a toner can be prevented, and hence charging performance can be stably maintained.

In addition, in Japanese Patent Application Laid-Open No. 2009-229907, a carrier for electrophotography in which carbon black is present at an interface between a first coating resin and a second coating resin sequentially formed on a magnetic material particle is used to solve a problem in that a coating resin peeled by wear migrates to a fixed image to make the tint of the fixed image turbid.

Nowadays, however, a burden to be imposed on a developer in a developing device tends to increase owing to, for example, a reduction in developer volume in association with the downsizing of the developing device and an increase in stirring speed of the developer by an increase in output speed thereof. As a result, particularly under a high-temperature and high-humidity environment, the spending of a toner or an external additive onto the surface of a magnetic carrier based on a water crosslinking force acting between the magnetic carrier and the toner progresses, and hence the charge-providing ability of the magnetic carrier reduces. In addition, the adsorption of moisture to the surface of the magnetic carrier progresses to temporarily reduce the strength of the coating resin of the magnetic carrier, and hence the shaving of the coating resin of the magnetic carrier occurs to reduce its charge-providing ability.

Even when the developer disclosed in Japanese Patent Application Laid-Open No. 2005-49478 or Japanese Patent Application Laid-Open No. 2004-333931 is used, a crack occurs in a coating resin on the surface of the magnetic carrier owing to a severe burden on the developer in a recent developing device, and hence a wax derived from a toner adheres to the crack portion in some cases. As a result, a fine particle derived from the toner adheres to the portion of the surface of the magnetic carrier to which the wax adheres, and hence the magnetic carrier cannot maintain carrier characteristics in its initial state and has insufficient durability. In addition, moisture adsorption progresses from the crack portion occurring in the coating resin on the surface of the magnetic carrier to reduce its charge-providing ability.

As described above, even the carrier disclosed in Japanese Patent Application Laid-Open No. 2005-49478 or Japanese Patent Application Laid-Open No. 2004-333931 is susceptible to further improvement.

In addition, in the case of each of Japanese Patent Application Laid-Open No. 2008-70662, Japanese Patent Application Laid-Open No. 2007-121911, and Japanese Patent Application Laid-Open No. 2009-229907, the shaving of a coating resin cannot be completely prevented.

SUMMARY OF THE INVENTION

The present invention is directed to providing a magnetic carrier that has solved such problems as described above. Specifically, the present invention is directed to providing a magnetic carrier that is excellent in wear resistance of a coating film even when used under a high-temperature and high-humidity environment for a long time period, that maintains a stable charge-providing ability, and that shows an image density and a tint-fluctuation stable against a fluctuation from a high-humidity environment to a low-humidity environment.

According to one embodiment of the present invention, there is provided a magnetic carrier, including:

a ferrite core particle having magnetism; and a coating resin, in which:

the coating resin has a surface resin layer, and a resin composition present between the ferrite core particle and the surface resin layer;

the rein composition contains a resin, and at least one selected from the group consisting of an inorganic particle and carbon black that are subjected to a hydrophilic treatment;

the surface resin layer (i) contains a resin, (ii) is free of the inorganic particle or the carbon black that is subjected to the hydrophilic treatment, and (iii) has a thickness in a range of from 0.01 μm or more to 4.00 μm or less; and a moisture percentage change (A-B) between a moisture percentage (A) when the magnetic carrier is left to stand under an environment having a temperature of 30° C. and a humidity of 80% RH for 24 hours, and a moisture percentage (B) when the magnetic carrier is left to stand under an environment having a temperature of 23° C. and a humidity of 5% RB for 24 hours after the standing under the environment having a temperature of 30° C. and a humidity of 80% RH for 24 hours is 0.030 mass % or less.

According to the present invention, the magnetic carrier that is excellent in wear resistance of a coating film even when used under a high-temperature and high-humidity environment for a long time period, that maintains a stable charge-providing ability, and that shows an image density and a tint fluctuation stable against a fluctuation from a high-humidity environment to a low-humidity environment can be obtained.

Further features of the present invention will become apparent from the following description of exemplary embodiments with reference to the attached drawings.

DESCRIPTION OF THE EMBODIMENTS

Figure 1:
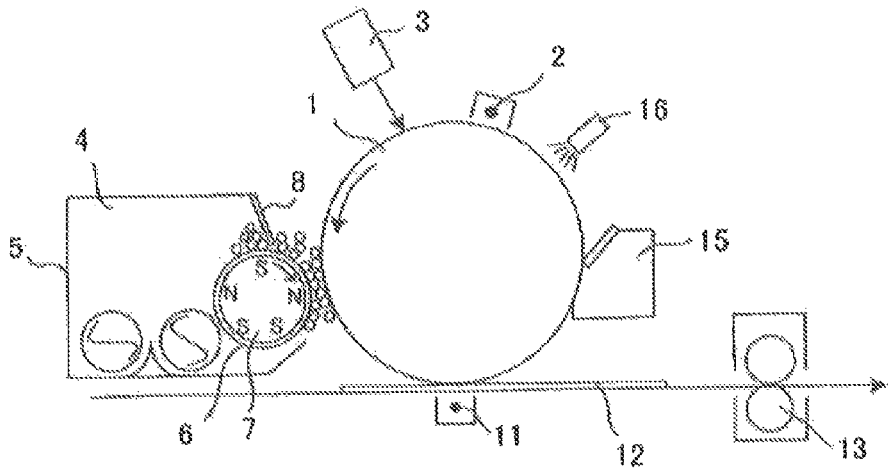
FIG. 1 is a schematic view in an example of an image-forming apparatus used in the present invention.

An embodiment of the present invention is described below.

(Carrier)

In a magnetic carrier of the present invention, a resin composition is arranged on the surface of a ferrite core particle by applying a resin solution having dispersed therein at least one selected from the group consisting of an inorganic particle and carbon black that are subjected to a hydrophilic treatment (hereinafter sometimes referred to as "hydrophilic-treated particle") to the surface and drying the solution. Subsequently, a resin solution free of an inorganic particle or carbon black that is subjected to the hydrophilic treatment is applied to form a surface resin layer containing a resin.

In the present invention, the thickness of the surface resin layer is 0.01 μm or more and 4.00 μm or less.

When a region having a thickness of less than 0.01 μm is present in the thickness of the surface resin layer, the moisture percentage change of the magnetic carrier at the time of an environmental change is increased by an influence of the hydrophilic-treated particle. As a result, the change of a moisture content, which largely affects the charging characteristics of the carrier, with a fluctuation from a high-temperature and high-humidity environment to a normal-temperature and low-humidity environment becomes larger, and hence a fluctuation with an environment becomes larger and a stable charge-providing ability cannot be maintained. As a result, a blank dot and a change in gradation at the time of a change in environment worsen.

Meanwhile, when a region having a thickness of more than 4.00 μm is present in the thickness of the surface resin layer, the moisture percentage change of the magnetic carrier at the time of an environmental change is increased by an influence of the desorption of moisture from the surface resin layer. As a result, the change of the moisture content, which largely affects the charging characteristics of the carrier, with a fluctuation from a high-temperature and high-humidity environment to a normal-temperature and low-humidity environment becomes larger, and hence a fluctuation with an environment becomes larger and a stable charge-providing ability cannot be maintained. As a result, a blank dot and a change in gradation at the time of a change in environment worsen.

An acrylic resin is preferably used as a resin to be incorporated into the resin composition (hereinafter referred to as "intermediate resin layer") present between the surface resin layer and the ferrite core particle because the resin has a high affinity for the surface resin layer and a high affinity for the ferrite core particle, and is rich in toughness.

A method of coating the surface of the ferrite core particle with a resin is not particularly limited, but the surface is coated with the resin by an application method, such as an immersion method, a spray method, a brushing method, a dry method, or a fluid bed method. The amount of the resin to be used in the coating is preferably 0.1 part by mass or more and 5.0 parts by mass or less with respect to 1.00 parts by mass of the ferrite core particle.

An acrylic resin is preferably used as the resin to be incorporated into the surface resin layer forming the outermost surface of the magnetic carrier (resin for the surface resin layer), the layer being formed outside the intermediate resin layer thus formed, because the resin has a high affinity for the intermediate resin layer (resin composition) and is rich in toughness.

A method of coating the surface of the intermediate resin layer with the resin for the surface resin layer is not particularly limited, but the surface is coated with the resin by an application method, such as an immersion method, a spray method, a brushing method, a dry method, or a fluid bed method. The amount of the resin to be used in the coating is preferably 0.1 part by mass or more and 5.0 parts by mass or less with respect to 1.00 parts by mass of the ferrite core particle.

In the magnet carrier of the present invention, a moisture percentage change (A-B) between a moisture percentage (A) of the magnetic carrier when the magnetic carrier is left to stand under an environment having a temperature of 30° C. and a humidity of 80% RH for 24 hours, and a moisture percentage (B) of the magnetic carrier when the magnetic carrier is left to stand under an environment having a temperature of 23° C. and a humidity of 5% RH for 24 hours after the standing under the environment having a temperature of 30° C. and a humidity of 80% RH for 24 hours is 0.030 mass % or less.

When the moisture percentage change is more than 0.030 mass %, the change of the moisture content, which largely affects the charging characteristics of the carrier, with a fluctuation from a high-temperature and high-humidity environment to a normal-temperature and low-humidity environment becomes larger, and hence a fluctuation with an environment becomes larger and a stable charge-providing ability cannot be maintained. As a result, a blank dot and a change in gradation at the time of a change in environment worsen.

(Inorganic Particle, Carbon Black)

The at least one particle selected from the group consisting of the inorganic particle and the carbon black (carbon black particle) that are subjected to the hydrophilic treatment, the at least one particle being incorporated into the intermediate resin layer of the present invention, is described.

Carbon black, $SrTiO_3$, $TiO_2$, $Al_2O_3$, MgO, or $SiO_2$ can be preferably used as each of the inorganic particle and the carbon black (hereinafter sometimes referred to as "treated particles") to be used in the present invention. When a treated particle except the foregoing is used, the moisture percentage change of the carrier may be increased by the moisture-adsorbing ability of the treated particle itself, and hence its environmental stability may reduce. Two or more kinds of the inorganic particles and the carbon black listed above may be used in combination.

In addition, in the present invention, it is preferred that no organic fine particle be used in the intermediate resin layer. When a thermosetting resin is used as an organic fine particle (treated particle), in terms of its production method, it Is assumed that resin molecular chains are randomly entangled with each other and hence a functional group showing hydrophilicity is hardly oriented toward the surface layer of the resin. Accordingly, the effects of the present invention, such as durability by virtue of an improvement in adhesiveness and the environmental stability, may be hardly expressed. When a thermoplastic resin is used, part of the resin may be dissolved in the resin solution, and hence a uniform coating layer is hardly formed. Accordingly, the effects of the present invention are also hardly obtained in some cases.

The at least one selected from the group consisting of the inorganic particle and the carbon black to be used in the present invention has an ester group and/or a carboxyl group on the surface of its substrate, and the total functional group concentration of the ester group and the carboxyl group is preferably 20% or more, more preferably 30% or more.

The functional group concentration represents the ratio of the functional groups (the ester group and the carboxyl group) to an element derived from the treated particle in X-ray photoelectron spectroscopy (hereinafter referred to as "XPS").

When the functional group concentration falls within the range, the carboxy group or the ester group present on the surface of the hydrophilic-treated particle and a water molecule in the surface resin layer form a hydrogen bond, and hence adhesiveness between the intermediate resin layer and the surface resin layer is improved by the interaction. In addition, when an acrylic resin is used in the surface resin layer, a π-bond portion in the acrylic resin and the carboxy group or the ester group present on the surface of the hydrophilic-treated particle cause a π-π interaction to improve the adhesiveness between the intermediate resin layer and the surface resin layer. In addition, adhesiveness between the intermediate resin layer and the ferrite core particle is improved by an interaction between a functional group on the surface of the hydrophilic-treated particle and a hydroxy group on the surface of the ferrite core particle. As a result, even when the carrier is used under a high-temperature and high-humidity environment for along time period, the wear resistance of the surface resin layer becomes excellent and hence a stable charge-providing ability can be maintained. That is, the charging characteristics of a toner become stable over a long time period, and hence the stability of the tint fluctuation of a mixed color, image coarseness resistance (dot reproducibility), developability, and gradation stability are improved. Further, carrier adhesion in a solid image that remarkably appears when the charge of the magnetic carrier itself is small tends to be hardly expressed. In addition, a water molecule in the surface resin layer is retained, and hence even when an environment changes, the moisture percentage of the magnetic carrier hardly changes. Accordingly, the moisture content, which largely affects the charging characteristics of the carrier, hardly changes with a fluctuation from a high-temperature and high-humidity environment to a normal-temperature and low-humidity environment, and hence a fluctuation with an environment is small and the stable charge-providing ability can be maintained. As a result, a blank dot at the time of a change in environment is suppressed, and hence the gradation stability is improved.

Meanwhile, when the functional group concentration is less than 20%, the number of the carboxy groups and the ester groups present on the surface of the hydrophilic-treated particle is small, and hence an interaction between any such group and the surface resin layer becomes smaller. As a result, the adhesiveness between the intermediate resin layer and the surface resin layer reduces. In addition, when an acrylic resin is used in the surface resin layer, a π-π interaction occurring between a π-bond portion in the acrylic resin and the carboxy group or the ester group present on the surface of the hydrophilic-treated particle becomes smaller, and hence the adhesiveness between the intermediate resin layer and the surface resin layer reduces. In addition, an interaction between a functional group on the surface of the hydrophilic-treated particle and a hydroxy group on the surface of the ferrite core particle becomes smaller, and hence the adhesiveness between the intermediate resin layer and the ferrite core particle reduces. As a result, when the carrier is used under a high-temperature and high-humidity environment for a long time period, the wear resistance of the surface resin layer reduces and hence a stable charge-providing ability cannot be maintained. That is, the charging characterstics of the toner do not become stable over a long time period, and hence the stability of the tint fluctuation of the mixed color, the image coarseness resistance (dot reproducibility), the developability, and the gradation stability deteriorate. Further, the charge of the magnetic carrier itself reduces and hence the carrier adhesion is liable to be expressed. In addition, a water molecule in the surface resin layer is hardly retained, and hence when an environment changes, the moisture percentage change of the magnetic carrier becomes larger. Accordingly, the moisture content, which largely affects the charging characteristics of the carrier, changes with a fluctuation from a high-temperature and high-humidity environment to a normal-temperature and low-humidity environment, and hence the stability of the charge-providing ability reduces. As a result, a blank dot and a change in gradation at the time of a change in environment worsen.

The volume-average particle diameter of the primary particles of the inorganic particles and the carbon black (treated particles) to be used in the present invention is preferably 10 nm or more and 1,000 nm or less.

In the case where the volume-average particle diameter is less than 10 nm, the particles are liable to aggregate and are dispersed in the state of an aggregate in the intermediate resin layer. In that case, a protruded portion resulting from the aggregate in the intermediate resin layer may occur on the surface of the magnetic carrier. Accordingly, under practical use, there is a risk in that a stress due to friction between the particles of the magnetic carrier concentrates on the protruded portion on the surface of the magnetic carrier, and hence the desorption of the aggregate from the intermediate resin layer involving the peeling of the surface resin layer occurs. Accordingly, the charge-providing ability may reduce in the portion. That is, the charging characteristics of the toner cannot be maintained over a long time period, and hence the stability of the tint fluctuation of the mixed color, the image coarseness resistance (dot reproducibility), the developability, and a change in gradation may deteriorate. Further, the carrier adhesion in a solid image that remarkably appears when the charge of the magnetic carrier itself is small tends to worsen. In addition, a water molecule in the surface resin layer is hardly retained in a stable manner owing to the desorption of the aggregate, and hence when an environment changes, the moisture percentage change of the magnetic carrier becomes larger. Accordingly, the change of the moisture content, which largely affects the charging characteristics of the carrier, with a fluctuation from a high-temperature and high-humidity environment to a normal-temperature and low-humidity environment becomes larger, and hence a fluctuation with an environment becomes larger and a stable charge-providing ability cannot be maintained. As a result, a blank dot and the change in gradation at the time of a change in environment may worsen.

In the case where the volume-average particle diameter is more than 1,000 nm, a protruded portion resulting from the aggregate in the intermediate resin layer may occur on the surface of the magnetic carrier. Accordingly, under practical use, there is a risk in that a stress due to friction between the particles of the magnetic carrier concentrates on the protruded portion on the surface of the magnetic carrier, and hence the desorption of the aggregate from the intermediate resin layer involving the peeling of the surface resin layer occurs. Accordingly, the charge-providing ability may reduce in the portion. That is, the charging characteristics of the toner cannot be maintained over a long time period, and hence the stability of the tint fluctuation of the mixed color, the image coarseness resistance (dot reproducibility), the developability, and the change in gradation may deteriorate. Further, the carrier adhesion in a solid image that remarkably appears when the charge of the magnetic carrier itself is small tends to worsen. In addition, a water molecule in the surface resin layer is hardly retained in a stable manner owing to the desorption of the aggregate, and hence when an environment changes, the moisture percentage change of the magnetic carrier becomes larger. Accordingly, the change of the moisture content, which largely affects the charging characteristics of the carrier, with a fluctuation from a high-temperature and high-humidity environment to a normal-temperature and low-humidity environment becomes larger, and hence a fluctuation with an environment becomes larger and a stable charge-providing ability cannot be maintained. As a result, a blank dot and the change in gradation at the time of a change in environment may worsen.

The intermediate resin layer of the present invention preferably contains 1.0 part by mass or more and 20.0 parts by mass or less of the hydrophilic-treated particle when the amount of the resin is defined as 100 parts by mass.

When the content of the hydrophilic-treated particle is less than 1.0 part by mass, the absolute amount of a functional group on the surface of the hydrophilic-treated particle that interacts with a water molecule in the surface resin layer reduces, and hence the adhesiveness between the intermediate resin layer and the surface resin layer is not improved. As a result, when the carrier is used under a high-temperature and high-humidity environment for a long time period, the wear resistance of the surface resin layer reduces and hence a stable charge-providing ability cannot be maintained. That is, the charging characteristics of the toner cannot be maintained over a long time period, and hence the stability of the tint fluctuation of the mixed color, the image coarseness resistance (dot reproducibility), the developability, and the change in gradation may deteriorate. Further, the carrier adhesion in a solid image that remarkably appears when the charge of the magnetic carrier itself is small tends to worsen. In addition, a retaining action on a water molecule in the surface resin layer becomes smaller, and hence when an environment changes, a moisture percentage change in the resin increases. As a result, the change of the moisture content, which largely affects the charging characteristics of the carrier, with a fluctuation from a nigh-temperature and high-humidity environment to a normal-temperature and low-humidity environment becomes larger, and hence a fluctuation with an environment becomes larger and the stable charge-providing ability cannot be maintained. As a result, a blank dot and the change in gradation at the time of a change in environment may worsen.

Meanwhile, when the content of the hydrophilic-treated particle is more than 20.0 parts by mass, the absolute amount of a functional group on the surface of the hydrophilic-treated particle that interacts with a water molecule in the surface resin layer increases, and hence the water molecule may be further attracted toward the intermediate resin layer.

As a result, the amount of a water molecule just near the surface layer of the surface resin layer reduces, and hence the layer adsorbs a water molecule in air. Accordingly, the moisture percentage of the entire resin increases. As a result, when the carrier is used under a high-temperature and high-humidity environment for a long time period, the wear resistance of the surface resin layer reduces and hence a stable charge-providing ability cannot be maintained. That is, the charging characteristics of the toner cannot be maintained over a long time period, and hence the stability of the tint fluctuation of the mixed color, the image coarseness resistance (dot reproducibility), the developability, and the change in gradation may deteriorate. Further, the carrier adhesion in a solid image that remarkably appears when the charge of the magnetic carrier itself is small tends to worsen. In addition, the moisture percentage of the surface resin layer increases, and hence when an environment changes, the moisture percentage change of the magnetic carrier becomes larger. As a result, the change of the moisture content, which largely affects the charging characteristics of the carrier, with a fluctuation from a high-temperature and high-humidity environment to a normal-temperature and low-humidity environment becomes larger, and hence a fluctuation with an environment becomes larger and the stable charge-providing ability cannot be maintained. As a result, a blank dot and the change in gradation at the time of a change in environment may worsen.

(Method for Hydrophilic Treatment)

The at least one selected from the group consisting of the inorganic particle and the carbon black to be incorporated into the intermediate resin layer of the present invention is required to satisfy the following: the surface of the particle is subjected to the hydrophilic treatment.

One method for the hydrophilic treatment is, for example, a method involving subjecting a commercial inorganic particle, neutral or basic carbon black, or acidic carbon black to an oxidation treatment to introduce a hydrophilic group.

A method for the oxidation treatment is specifically, for example, an oxidation method based on air contact, such as a vapor phase oxidation method based on a reaction with a nitrogen oxide or ozone. In addition, the method is, for example, a liquid phase oxidation method using an oxidant, such as nitric acid, potassium permanganate, potassium dichromate, chlorous acid, perchloric acid, a hypohalous acid, hydrogen peroxide, an aqueous solution of bromine, or an aqueous solution of ozone. In addition to the foregoing, carbon black whose surface is subjected to art oxidation treatment by a plasma treatment or the like can be similarly applied.

Although there exist various methods each involving subjecting the surface of the particle to the oxidation treatment as described above to introduce a hydrophilic group, for example, such a method as described below is preferably adopted. When the liquid phase oxidation method is performed, carbon black is loaded into a proper container, and an aqueous solution of nitric acid is added to the container to perform reflux, followed by washing and drying. Thus, the hydrophilic-treated particle can be obtained. When the vapor phase oxidation method is performed, each particle is loaded into a tubular ozonization device, and the particle is exposed under an ozone atmosphere by generating ozone with an ozone generator. Thus, the hydrophilic-treated particle can be obtained.

Another method for the hydrophilic treatment is, for example, a method involving introducing a hydrophilic ester group or a carboxyl group of a lower fatty acid into a hydroxy group on the surface of the particle with a hydrophilic esterifying agent or a carboxylating agent of the lower fatty acid.

Specific examples of the hydrophilic esterifying agent include acetic anhydride, acetic acid chloride, acetic acid, propionic anhydride, succinic anhydride, maleic anhydride, phthalic anhydride, a polyglycerol fatty acid ester, and alginic acid. Two or more kinds of those hydrophilic esterifying agents or carboxylating agents of lower fatty acids may be used as a mixture.

As such method for the hydrophilic treatment as described above, there exist various methods each involving introducing a hydrophilic ester group or a carboxyl group of a lower fatty acid into a hydroxy group on the surface of the particle with a hydrophilic esterifying agent or a carboxylating agent of the lower fatty acid. For example, such a method as described below is preferably adopted. Each particle species is loaded into a proper container and a nitrogen atmosphere is established in the system. After that, anhydrous toluene, triethylamine, dimethylaminopyridine, and acetic anhydride are added to the container, and the mixture is subjected to a reaction at room temperature to provide a chemically modified particle. After that, the resultant chemically modified particle is loaded into a proper container. Methanol and calcium carbonate are added to the container, and the mixture is subjected to a reaction at room temperature. After that, a reaction-stopping treatment is performed, and washing and drying are performed. Thus, the hydrophilic-treated particle can be obtained.

(Ferrite Core Particle)

The ferrite core particle to be used in the present invention is described.

A material for the core particle (ferrite core particle) of the magnetic carrier is preferably magnetite or ferrite.

Further, the ferrite core particle may be a resin-filled magnetic core having a porous magnetic core particle and a resin filled into a pore of the porous magnetic core particle. A material for the porous magnetic particle (porous magnetic core particle) is more preferably ferrite because the porous structure of the porous magnetic particle can be controlled and its resistance can be adjusted.

The ferrite is a sintered body represented by the following general formula.

$$(M1_2O)_x(M2O)_y(Fe_2O_3)_z$$

(In the formula, M1 represents a monovalent metal, M2 represents a divalent metal, and when x+y+z equals 1.0, x and y each satisfy the relationship of $0 \leq (x, y) \leq 0.8$ and z satisfies the relationship of $0.2 < z < 1.0$.)

In the formula, M1 and M2 each preferably represent one or more kinds of metal atoms selected from the group consisting of Li, Fe, Mn, Mg, Sr, Cu, Zn, and Ca. In addition, Ni, Co, Ba, Y, V, Bi, In, Ta, Zr, B, Mo, Na, Sn, Ti, Cr, Al, Si, rare earthes, and the like can also be used.

A method of producing the ferrite core particles is, for example, as described below. An oxide, carbonate, or nitrate of a metal are mixed by a wet process or a dry process, and the mixture is pre-calcined so as to have desired ferrite composition. Next, the resultant ferrite core particles are pulverized to submicrons. In order to adjust the particle diameter of the core (core particle) of the magnetic carrier, 20 mass % or more and 50 mass % or less of water is added to the pulverized ferrite particles. Then, a slurry is prepared by adding, for example, a polyvinyl alcohol (having a molecular weight of 500 or more and 10,000 or less) as a binder resin at a content of 0.1 mass % or more and 10 mass % or less to the mixture. The slurry is granulated with a spray dryer or the like and calcined. Thus, the ferrite core particles can be obtained.

The porous magnetic core particle is required to satisfy the following: its magnetization amount is moderately maintained, its pore diameter is set to fall within a desired range, and the state of unevenness on the surface of the porous magnetic core particle is made suitable. The particle is also required to satisfy the following: the rate of a ferritization reaction can be easily controlled, and the specific resistance and magnetic force of the porous magnetic core particle can be suitably control led. From the foregoing viewpoints, a Mn-based ferrite, a Mn—Mg-based ferrite, a Mn—Mg—Sr-based ferrite, and a Li—Mn-based ferrite each containing a Mn element are more preferred.

Production steps in the case of using the ferrite core particles as the porous magnetic core particles are described in detail below.

<Step 1 (Weighing/Mixing Step)>

Ferrite raw materials are weighed and mixed. Examples of the ferrite raw materials include metal particles, oxides, hydroxide, oxalates, and carbonates of the metal atoms.

Examples of an apparatus for the mixing include the following: a ball mill, a planetary mill, a giotto mill, and a vibrating mill. Of those, a ball mill is particularly preferred from the viewpoint of mixability. Specifically, the weighed ferrite raw materials and balls are loaded into the ball mill, and the raw materials are pulverized and mixed for 0.1 hour or more and 20.0 hours or less.

<Step 2 (Pre-Calcination Step)>

The pulverized and mixed ferrite raw materials are ferritized by pre-calcining the materials in the air at a calcination temperature in the range of from 700° C. or more to 1,200° C. or less for 0.5 hour or more and 5.0 hours or less. For example, any one of the following furnaces is used in the calcination: a burner combustion type furnace, a rotary type calcining furnace, and an electric furnace.

<Step 3 (Pulverization Step)>

The pre-calcined ferrite produced in the step 2 is pulverized with a pulverizer.

The pulverizer is not particularly limited as long as a desired particle diameter is obtained. Examples thereof include the following: a crusher, a hammer mill, a ball mill, a bead mill, a planetary mill, and a giotto mill.

In order to set the particle diameter of a pulverized product of the ferrite to a desired value, in the case of, for example, a ball mill or a bead mill, the materials and particle diameters of balls or beads to be used, and an operation time are preferably controlled. Specifically, in order that the particle diameter of a pre-calcined ferrite slurry may be reduced, it is sufficient that a ball having a high specific gravity be used or a pulverization time be lengthened. In addition, a wide particle size distribution of the pre-calcined ferrite can be obtained by using balls or beads each having a high specific gravity and shortening the pulverization time. In addition, the pre-calcined ferrite having a wide particle size distribution can be obtained by mixing a plurality of pre-calcined ferrites having different particle diameters.

In addition, a wet ball mill or bead mill has higher pulverization efficiency than that of a dry one because a pulverized product does not soar in the mill. Accordingly, the wet one is more preferred to the dry one.

<Step 4 (Granulation Step)>

Water and a binder, and as required, a pore adjustor may be added to the pulverized product of the pre-calcined ferrite. Examples of the pore adjustor include a foaming agent and resin fine particles.

Examples of the foaming agent include sodium hydrogen carbonate, potassium hydrogen carbonate, lithium hydrogen carbonate, ammonium hydrogen carbonate, sodium carbonate, potassium carbonate, lithium carbonate, and ammonium carbonate.

Examples of the resin fine particles include fine particles formed of: polyester, polystyrene, and styrene copolymers, such as a styrene-vinyl toluene copolymer, a styrene-vinyl naphthalene copolymer, a styrene-acrylic acid ester copolymer, a styrene-methacrylic acid ester copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, and a styrene-acrylonitrile-indene copolymer; polyvinyl chloride, a phenol resin, a modified phenol resin, a maleic resin, an acrylic resin, a methacrylic resin, polyvinyl acetate, and a silicone resin; a polyester resin having, as a structural unit, a monomer selected from aliphatic polyhydric alcohols, aliphatic dicarboxylic acids, aromatic dicarboxylic acids, aromatic dialcohols, and diphenols; a polyurethane resin, a polyamide resin, polyvinyl butyral, a terpene resin, a coumarone-indene resin, a petroleum resin, and a hybrid resin having a polyester unit and a vinyl-based polymer unit.

For example, polyvinyl alcohol is used as the binder.

When the pulverization is performed by the wet process in the step 3, the binder, and as required, the pore adjustor are preferably added in consideration of water in the ferrite slurry.

The resultant ferrite slurry is dried and granulated with a spray drying machine under a warming atmosphere of 100° C. or more and 200° C. or less. The spray drying machine is not particularly limited as long as a desired particle diameter of the porous magnetic particle is obtained. For example, a spray drier can be used.

<Step 5 (Main Calcination Step)>

Next, the granulated product is calculated at 800° C. or more and 1,400° C. or less for 1 hour or more and 24 hours or less. When a calcination temperature is increased and a calcination time is lengthened, the calcination of the porous magnetic core particles progresses. As a result, their pore diameters reduce and the numbers of their pores also reduce.

<Step 6 (Sorting Step)>

After the particles calcined as described above have been disintegrated, coarse particles and fine particles may be removed as required by classification or sifting with a sieve. The 50% particle diameter (D50) on a volume distribution basis of the ferrite core particles (magnetic core particles) is more desirably 18.0 μm or more and 68.0 μm or less for the suppression of the adhesion of the carrier to an image and image coarseness.

The physical strength of the porous magnetic core particle may reduce depending on the volumes of pores therein. Accordingly, in order that the physical strength as the magnetic carrier may be improved, a resin is preferably filled into at least part of the pores of the porous magnetic core particle. The amount of the resin to be filled into the porous magnetic core particle is preferably 2 mass % or more and 15 mass % or less with respect to the porous magnetic core particle. As long as a variation in resin content between the particles of the magnetic carrier is small, the resin may be filled into only part of the internal gaps. Alternatively, the following is permitted the resin is filled into only a gap near the surface of the porous magnetic core particle, and some gaps remain in the particle. Alternatively, the resin may be filled into all the internal gaps.

A method of filing the resin into a pore of the porous magnetic core particle is not particularly limited, but for example, the following method is available: the porous magnetic core particle is impregnated with a solution of the resin by an application method, such as an immersion method, a spray method, a brushing method, or a fluid bed method, and then a solvent is volatilized. A method involving diluting the resin with the solvent to prepare the resin solution and adding the solution to a gap of the porous magnetic core particle can be adopted as the method of filling the resin into the gap of the porous magnetic core particle. The solvent to be used in this case only needs to be capable of dissolving the resin. When the resin is soluble in an organic solvent, examples of the organic solvent include toluene, xylene, cellosolve, butyl acetate, methyl ethyl ketone, methyl isobutyl ketone, and methanol. In addition, when the resin is a water-soluble resin or an emulsion-type resin, it is sufficient that water be used as the solvent.

The amount of a resin solid content in the resin solution is preferably 1 mass % or more and 50 mass % or less, more preferably 1 mass % or more and 40 mass % or less. When a resin solution in which the amount of a resin solid content is more than 50 mass % is used, its viscosity is so high that it becomes hard for the resin solution to uniformly permeate the gaps of the porous magnetic core particle. In addition, when the amount of the resin solid content is less than 1 mass %, the amount of the resin solid content is so small that the adhesive force of the resin to the porous magnetic core particle may reduce.

When a thermoplastic resin is used as the resin to be filled, examples thereof include a novolac resin, a saturated alkyl polyester resin, a polyarylate resin, and a polyamide resin. In addition, when a thermosetting resin is used as the resin to be filled, examples thereof include a silicone resin, a phenolic-based resin, an epoxy resin, and an unsaturated polyester resin.

(Toner)

The construction of a toner preferred for achieving the object in the present invention is described in detail below, but the present invention is by no means limited thereto.

The toner contains a binder resin and a colorant, and may contain a magnetic material, a releasing agent, a charge control agent, or the like as required. Further, an external additive for improving various properties, such as flowability, may be caused to adhere to the surface of a toner particle.

Examples of the binder resin to be used in the present invention include a vinyl-based resin, a polyester-based resin, and an epoxy resin. Of those, a vinyl-based resin and a polyester-based resin are more preferred from the viewpoints of chargeability and fixability.

In the present invention, the binder resin can be mixed with a homopolymer or a copolymer of a vinyl-based monomer, polyester, polyurethane, an epoxy resin, polyvinyl butyral, rosin, modified rosin, a terpene resin, a phenol resin, an aliphatic or alicyclic hydrocarbon resin, an aromatic petroleum resin, or the like before use, as required.

When two or more kinds of resins are mixed to be used as the binder resin, it is more preferred that resins having different molecular weights be mixed at an appropriate ratio.

The glass transition temperature (Tg) of the binder resin is preferably 45° C. or more and 80° C. or less, more preferably 55° C. or more and 70° C. or less. In addition, the number-average molecular weight (Mn) of the binder resin is preferably 1,000 or more and 50,000 or less, and the weight-average molecular weight (Mw) thereof is preferably 5,000 or more and 1,000,000 or less.

The binder resin is also preferably a polyester resin shown below.

The polyester resin contains 45 mol % or more and 55 mol % or less of an alcohol component and 45 mol % or more and 55 mol % or less of an acid component among all the components.

The acid number of the polyester resin is preferably 90 mgKOH/g or less, more preferably 50 mgKOH/g or less, and the OH number (hydroxyl number) thereof is preferably 50 mgKOH/g or less, more preferably 30 mgKOH/g or less. This is because the environmental dependence of the charging characteristics of the toner becomes larger as the number of the terminal groups of a molecular chain increases.

The glass transition temperature (Tg) of the polyester resin is preferably 50° C. or more and 75° C. or less, more preferably 55° C. or more and 65° C. or less. The number-average molecular weight (Mn) of the polyester resin is preferably 1,500 or more and 50,000 or less, more preferably 2,000 or more and 20,000 or less. The weight-average molecular weight (Mw) of the polyester resin is preferably 6,000 or more and 100,000 or less, more preferably 10,000 or more and 90,000 or less.

When the toner according to the present invention is used as a magnetic toner, the magnetic toner contains a magnetic material. Examples of the magnetic material contained in the magnetic toner include: iron oxides, such as magnetite, maghemite, and ferrite, and other iron oxides containing metal oxides; metals, such as Fe, Co, and Ni, or alloys of the metals with metals, such as Al, Co, Cu, Pb, Mg, Ni, Sn, Zn, Sb, Be, Bi, Cd, Ca, Mn, Se, Ti, W, and V; and mixtures thereof.

Specific examples of the magnetic material include tritron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), and nickel powder (Ni).

The magnetic toner contains, with respect to 100 parts by mass of the binder resin, preferably 20 parts by mass or more and 150 parts by mass or less, more preferably 50 parts by mass or more and 130 parts by mass or less, still more preferably 60 parts by mass or more and 120 parts by mass or less of the magnetic material.

A non-magnetic colorant to be used in the present invention includes the following.

A black colorant includes the following: carbon black; and a black colorant prepared by using a yellow colorant, a magenta colorant, and a cyan colorant.

A coloring pigment for magenta toner includes the following: a condensed azo compound, a diketopyrrolopyrrole compound, anthraquinone, a quinacridone compound, a basic dye lake compound, a naphthol compound, a benzimidazolone compound, a thioindigo compound, and a perylene compound. Specific examples thereof include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, or 269; C.I. Pigment Violet 19; and C.I. Vat Red 1, 2, 10, 13, 15, 23, 29, or 35.

In the colorant, a pigment may be used alone. However, it is preferred that a dye and a pigment are used in combination to improve the color definition of the colorant from the viewpoint of the image quality of a full color image.

A dye for magenta toner includes the following: oil-soluble dyes, such as C.I. Solvent Red 1, 3, 8, 23, 24, 25, 27, 30, 49, 81, 82, 83, 84, 100, 109, or 121, C.I. Disperse Red 9, C.I. Solvent Violet 8, 13, 14, 21, or 27, and C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, or 40, and C.I. Basic Violet 1, 3, 7, 10, 14, 15, 21, 25, 26, 27, or 28.

A coloring pigment for cyan toner includes the following: C.I. Pigment Blue 1, 2, 3, 7, 15:2, 15:3, 15:4, 16, 17, 60, 62, or 66; C.I. Vat Blue 6; C.I. Acid Blue 45; and a copper phthalocyanine pigment having a phthalocyanine skeleton with 1 to 5 phthalimidomethyl substituents.

A coloring pigment for yellow toner includes the following: a condensed azo compound, an isoindolinone compound, an anthraquinone compound, an azo metallic compound, a methine compound, and an arylamide compound. Specific examples thereof include: C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, or 191; and C.I. Vat Yellow 1, 3, or 20. Further, dyes, such as C.I. Direct Green 6, C.I. Basic Green 4, C.I. Basic Green 6, and C.I. Solvent Yellow 162, may be used.

The content of the colorant in the toner particle is preferably 0.1 part by mass or more and 30 parts by mass or less, more preferably 0.5 part by mass or more and 20 parts by mass or less, most preferably 3 parts by mass or more and 15 parts by mass or less with respect to 100 parts by mass of the binder resin.

Further, in the toner, it is preferred to use a master batch formed by mixing the colorant with the binder resin in advance. Then, the colorant master batch and other taw materials (such as a binder resin and a wax) can be melt-kneaded to disperse the colorant in the toner satisfactorily.

A charge control agent can be used as required for further stabilizing the chargeability of the toner according to the present invention. The content of the charge control agent is preferably 0.5 part by mass or more and 10 parts by mass or less with respect to 100 parts by mass of the binder resin. When the content is 0.5 part by mass or more, more sufficient charging characteristics are obtained. When the content is 10 parts by mass or less, the deterioration of the compatibility with any other material is suppressed, and its excessive charging under low humidity is suppressed.

The charge control agent includes the following.

As a negative charge control agent for controlling a toner to be negatively charged, for example, an organometallic complex or a chelate compound is effective. Examples thereof include a monoazo metal complex, an aromatic hydroxycarboxylic acid metal complex, and an aromatic dicarboxylic acid-based metal complex. Further examples thereof include an aromatic hydroxycarboxylic acid, aromatic mono- and polycarboxylic acids and metal salts thereof, anhydrides thereof, or esters thereof, and a phenol derivative of bisphenol.

As a positive charge control agent for controlling a toner to be positively charged, there are given, for example: nigrosine and denatured products of nigrosine with fatty acid metal salts and the like; quaternary ammonium salts, such as tributylbenzylammonium-1-hydroxy-4-naphtholsulfonate and tetrabutylammonium tetrafluoroborate; onium salts, such as phosphonium salts as analogs of the quaternary ammonium salts, triphenylmethane dyes as chelate pigments of the salts, lake pigments thereof (lake agents including phosphotungstic acid, phosphomolybdic acid, phosphotungsten molybdic acid, tannic acid, lauric acid, gallic acid, ferricyanic acid, and a ferrocyanide compound), and metal salts of higher fatty acids; diorganotin oxides, such as dibutyltin oxide, dioctyltin oxide, and dicyclohexyltin oxide; and diorganotin borates, such as dibutyltin borate, dioctyltin borate, and dicyclohexyltin borate.

In the present invention, the toner particles may contain one kind or two or more kinds of releasing agents as required. Examples of the releasing agents include the following.

For example, aliphatic hydrocarbon-based waxes, such as low-molecular weight polyethylene, low-molecular weight polypropylene, a microcrystalline wax, and a paraffin wax, can be preferably used. In addition, there are given: oxides of aliphatic hydrocarbon-based waxes, such as a polyethylene oxide wax, or block copolymers thereof; waxes mainly including fatty acid esters, such as a carnauba wax, a sasol wax, and a montanic acid ester wax; and partially or wholly deacidified fatty acid esters, such as a deacidified carnauba wax.

The content of the releasing agent in the toner particle is preferably 0.1 part by mass or more and 20 parts by mass or less, more preferably 0.5 part by mass or more and 10 parts by mass or less with respect to 100 parts by mass of the binder resin.

In addition, the melting point of the releasing agent specified by the highest endothermic peak temperature at the time of its temperature increase measured with a differential scanning calorimeter (DSC) is preferably 65° C. or more and 130° C. or less, more preferably 80° C. or more and 125° C. or less. When the melting point is 65° C. or more, the adhesion of the toner to an electrophotographic photosensitive member is suppressed. When the melting point is 130° C. or less, the deterioration of the low-temperature fixability of the toner is suppressed.

In the toner according to the present invention, an external additive that can, when externally added to a toner particle thereof, improve its flowability after the addition as compared to that before the addition may be used as a flowability improver. Examples thereof include: fluorine-based resin particles, such as vinylidene fluoride fine particles and polytetrafluoroethylene fine particles; and hydrophobic-treated fine particles obtained by subjecting, for example, silica fine particles, such as silica fine particles produced by a wet process and silica fine particles produced by a dry process, titanium oxide fine particles, or alumina fine particles to a surface treatment with a silane coupling agent, a titanium coupling agent, or a silicone oil. Of the hydrophobic-treated fine particles, fine particles treated so as to show a hydrophobicity, which is a value measured by a methanol titration test, in the range of from 30 or more to 80 or less are particularly preferred.

The content of the external additive in the present invention is preferably 0.1 part by mass or more and 10 parts by mass or less, more preferably 0.2 part by mass or more and 8 parts by mass or less with respect to 100 parts by mass of the toner particle.

When the toner according to the present invention is used as a two-component developer by being mixed with a magnetic carrier, a carrier mixing ratio at the time is preferably 2 mass % or more and 15 mass % or less, more preferably 4 mass % or more and 13 mass % or less in terms of the concentration of the toner in the developer. When the toner concentration is less than 2 mass %, an image density is liable to reduce, and when the toner concentration is more than 15 mass %, fogging or scattering in a machine is liable to occur.

In addition, in a replenishing developer with which a developing device is to be replenished in accordance with a reduction in toner concentration of a two-component developer in the developing device, a toner amount is 2 parts by mass or more and 50 parts by mass or less with respect to 1 part by mass of a replenishing magnetic carrier.

Next, an image-forming apparatus including a developing apparatus using the magnetic carrier or two-component developer of the present invention is described by taking an example, but a developing apparatus to be used in a developing method according to the present invention is not limited thereto.

<Image-Forming Method>

Figure 2:
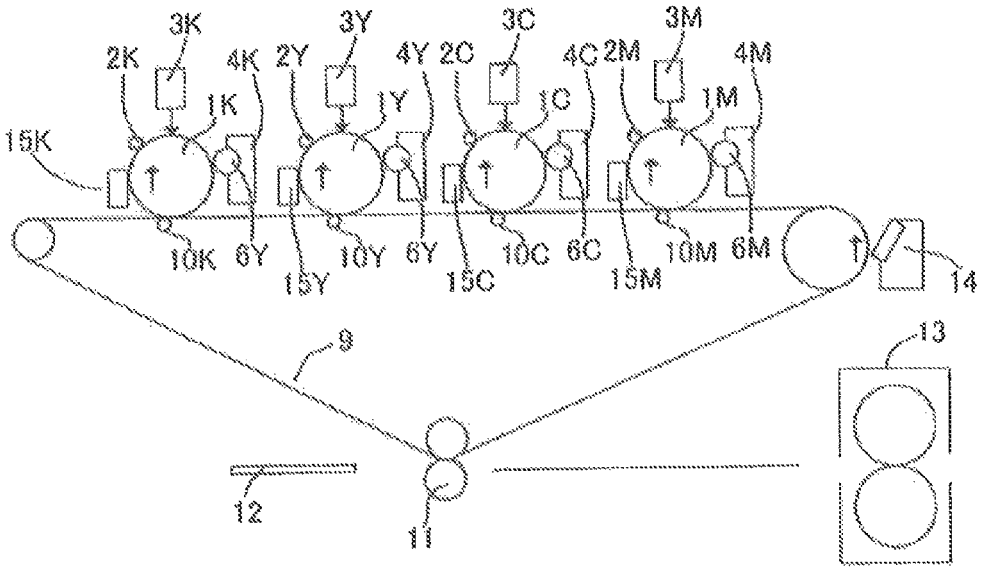
FIG. 2 is a schematic view in an example of the image-forming apparatus used in the present invention.

In FIG. 1, an electrostatic latent image-bearing member 1 rotates in a direction indicated by the arrow in the figure. The electrostatic latent image-bearing member 1 is charged by a charging device 2 serving as charging means, and an electrostatic latent image is formed by exposing the surface of the charged electrostatic latent image-bearing member 1 to light with an exposing device 3 serving as electrostatic latent image-forming means. A developing device 4 includes a developer container 5 storing a two-component developer, and in the device, a developer bearing member 6 is arranged in a state of being rotatable. In addition, the developer bearing member 6 includes in itself magnets (magnetic poles) 7 each serving as magnetic field-generating means. At least one of the magnets 7 is arranged so as to be at a position opposite to the electrostatic latent image-bearing member 1. The two-component developer is held on the developer bearing member 6 by the magnetic field of the magnets 7. The amount of the two-component developer is regulated by a regulating member 8, and the developer is conveyed to a developing portion opposite to the electrostatic latent image-bearing member 1. In the developing portion, a magnetic brush is formed by the magnetic field generated by the magnets 7. After that, the electrostatic latent image is visualized as a toner image by applying a developing bias obtained by superimposing an alternating electric field on a direct electric field. The toner image formed on the electrostatic latent image-bearing member 1 is electrostatically transferred onto a recording medium 12 by a transfer charging device 11. In this case, the following may be performed: as illustrated in FIG. 2, the toner image is transferred from the electrostatic latent image-bearing member 1 onto an intermediate transfer member 9 once, and is then electrostatically transferred onto the transfer material (recording medium) 12. After that, the recording medium 12 is conveyed to a fixing device 13, and is heated and pressurized in the device. Thus, a toner is fixed onto the recording medium 12. After that, the recording medium 12 is discharged as an output image to the outside of the apparatus. After a transfer step, the toner remaining on the electrostatic latent image-bearing member 1 is removed by a cleaner 15. After that, the electrostatic latent image-bearing member 1 cleaned by the cleaner 15 is electrically initialized by irradiation with light from a pre-exposing device 16, and the above-mentioned image-forming operation is repeated.

FIG. 2 is an illustration of an example of a schematic view of the case where the image-forming method according to the present invention is applied to a full-color image-forming apparatus.

The arrangement of image-forming units K, Y, C, M, and the like, and the arrows indicating rotation directions in the figure are by no means limited to those illustrated in the figure. Incidentally, K means black, Y means yellow, C means cyan, and M means magenta. In FIG. 2, electrostatic latent image-bearing members 1K, 1Y, 1C, and 1M rotate in directions indicated by the arrows in the figure. The respective electrostatic latent image-bearing members 1K, 1Y, 1C, and 1M are charged by charging devices 2K, 2Y, 2C, and 2M each serving as charging means, respectively, and electrostatic latent images are formed by exposing the surfaces of the respective charged electrostatic latent image-bearing members 1 to light with exposing devices 3K, 3Y, 3C, and 3M each serving as electrostatic latent image-forming means. After that, the electrostatic latent images are visualized as toner images by two-component developers carried on developer bearing members 6K, 6Y, 6C, and 6M included in developing devices 4K, 4Y, 4C, and 4M each serving as developing means. Further, the images are transferred onto the intermediate transfer member 9 by intermediate transfer charging devices (primary transfer rollers) 10K, 10Y, 10C, and 10M each serving as transferring means. Further, the images are transferred onto the recording medium 12 by the transfer charging device (secondary transfer roller) 11 serving as transferring means, and the recording medium 12 is subjected to fixation under heating and pressure by the fixing device 13 serving as fixing means to be output as an image. Then, an intermediate transfer member cleaner 14 serving as a member for cleaning the intermediate transfer member 9 recovers a transfer residual toner and the like. In addition, toners remaining on the electrostatic latent image-bearing members 1K, 1Y, 1C, and 1M after the transfer onto the intermediate transfer member 9 are removed by cleaners (electrostatic latent image-bearing member cleaners) 15K, 15Y, 15C, and 15M, respectively. In the developing method according to the present invention, specifically, development is preferably performed under a state in which a magnetic brush is in contact with a photosensitive member while an alternating electric field is formed in a developing region by the application of an AC voltage to a developer bearing member. A distance (S-D distance) between the developer bearing member (developing sleeve) 6 and the electrostatic latent image-bearing member (electrophotographic photosensitive drum) 1 is preferably 100 μm or more and 1,000 μm or less from the viewpoints of the suppression of carrier adhesion and an improvement in dot reproducibility. When the distance is less than 100 μm, the supply of a developer is liable to be insufficient, and hence an image density reduces. When the distance is more than 1,000 μm, lines of magnetic force from magnetic poles spread to reduce the density of the magnetic brushes, and hence the dot reproducibility deteriorates. Alternatively, a force for binding a magnetic carrier weakens and hence the carrier adhesion is liable to occur.

The peak-to-peak voltage (Vpp) of the alternating electric field is 300 V or more and 3,000 V or less, preferably 500 V or more and 1,800 V or less. In addition, its frequency is 500 Hz or more and 10,000 Hz or less, preferably 1,000 Hz or more and 7,000 Hz or less. The voltage and the frequency can each be appropriately selected and used depending on a process. In this case, the waveform of an AC bias for forming the alternating electric field is, for example, a triangular wave, a rectangular wave, a sinusoidal wave, or a waveform whose duty ratio is changed. On occasions, in order to correspond to a change in speed at which a toner image is formed, the development is preferably performed by applying a developing bias voltage having a discontinuous AC bias voltage (intermittent alternating superimposed voltage) to a developer bearing member. When the applied voltage is less than 300 V, a sufficient image density is hardly obtained, and a fogging toner in a non-image portion cannot be satisfactorily recovered in some cases. In addition, when the applied voltage is more than 3,000 V, an electrostatic latent image is disturbed through a magnetic brush, and the disturbance causes a reduction in image quality in some cases.

When a two-component developer containing a satisfactorily charged toner is used, a fogging-removing voltage (Vback) can be reduced and the primary charging of an electrophotographic photosensitive member can be reduced, and hence the lifetime of the photosensitive member can be lengthened. The Vback is preferably 200 V or less, more preferably 150 V or less, though a preferred value varies depending on a developing system. A potential of 100 V or more and 400 V or less is preferably used as a contrast potential so that a sufficient image density may be obtained.

In addition, when the frequency is less than 500 Hz, although a process speed affects, but the construction of the electrophotographic photosensitive member may be the same as that of an electrophotographic photosensitive member to be used in an ordinary image-forming apparatus. The electrophotographic photosensitive member has, for example, a construction in which a conductive layer, an undercoat layer, a charge-generating layer, and a charge-transporting layer in the stated order, and as required, a charge-injecting layer are arranged on a conductive substrate, such as aluminum or SUS.

The conductive layer, the undercoat layer, the charge-generating layer, and the charge-transporting layer may be layers to be used in an ordinary electrophotographic photosensitive member. For example, the charge-injecting layer or a protective layer may be used as the outermost surface layer of the photosensitive member.

<Method of Measuring Volume-Average Particle Diameter (D50) of Each of Magnetic Carrier and Porous Magnetic Core Particles>

Particle size distribution measurement was performed with a particle size distribution-measuring apparatus "Microtrac MT3300EX" (manufactured by MicrotracBEL Corp. (formerly Nikkiso Co., Ltd.)) of a laser diffraction/scattering system.

At the time of the measurement of the volume-average particle diameter (D50) of each of the magnetic carrier and the porous magnetic core particles, a sample-supplying machine "one-shot dry type sample conditioner Turbotrac" (manufactured by MicrotracBEL Corp.) for dry measurement was mounted onto the apparatus. Supplying conditions of the Turbotrac are as described below. A dust collector was used as a vacuum source, and its airflow rate and pressure were set to about 33 l/sec and about 17 kPa, respectively. The control is automatically performed on software. A 50% particle diameter (D50) as a volume-average accumulated value is determined as a particle diameter. The control and the analysis are performed with the software included with the machine (version 10.3.3-202D). Conditions for the measurement are as described below.

| | |
|---|---|
| Set Zero time: | 10 seconds |
| Measurement time: | 10 seconds |
| Meaurement frequency: | 1 |
| Particle refractive index: | 1.81% |
| Particle shape: | nonspherical |
| Measurement upper limit: | 1,408 μm |
| Measurement lower limit: | 0.243 μm |
| Measurement environment: | 23° C., 50% RH |

<Methods of Measuring Weight-Average Particle Diameter (D4) and Number-average Particle Diameter (D1) of Toner>

The weight-average particle diameter (D4) and the number-average particle diameter (D1) of the toner were measured with the number of effective measurement channels of 25,000 by using a precision particle size distribution measuring apparatus based on a pore electrical resistance method provided with a 100-micrometer aperture tube "Coulter Counter Multisizer 3" (trademark, manufactured by Beckman Coulter, Inc.) and dedicated software included therewith "Beckman Coulter Multisizer 3 Version 3.51" (manufactured by Beckman Coulter, Inc.) for setting measurement conditions and analyzing measurement data. Then, the measurement data was analyzed to calculate the diameters.

An electrolyte solution prepared by dissolving reagent grade sodium chloride in ion-exchanged water so as to have a concentration of about 1 mass %, for example, "ISOTON II" (manufactured by Beckman Coulter, Inc.) can be used in the measurement.

The dedicated software was set as described below prior to the measurement and the analysts.

In the "Change Standard Operating Method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "Threshold/Measure Noise Level" button. In addition, a current is set to 1,600 μA, a gain is set to 2, and an electrolyte solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method is as described be low.

(1) About 200 ml of the electrolyte solution is charged into a 250-milliliter round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "Flush Aperture" function of the dedicated software.

(2) About 30 ml of the electrolyte solution is charged into a 100-milliliter flat-bottom beaker made of glass. About 0.3 ml of a diluted solution prepared by diluting "Contaminon N" (10 mass % aqueous solution of a neutral detergent for washing a precision measuring device formed of a nonionic surfactant, an anionic surfactant, and an organic builder and having a pH of 7 manufactured by Wako Pure Chemical Industries, Ltd.) with ion-exchanged water by three parts by mass fold is added as a dispersant to the electrolyte solution.

(3) A predetermined amount of ion-exchanged water is charged into the water tank of an ultrasonic dispersing unit "Ultrasonic Dispension System Tetora 150" (manufactured by Nikkaki Bios Co., Ltd.) in which two oscillators each having an oscillatory frequency of 50 kHz are built so as to be out of phase by 180° and which has an electrical output of 120 W. About 2 ml of the Contaminon N is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte solution in the beaker may resonate with an ultrasonic wave from the ultrasonic dispersing unit to the fullest extent possible.

(5) About 10 mg of a toner is gradually added to and dispersed in the electrolyte solution in the beaker in the section (4) under a state in which the electrolyte solution is irradiated with the ultrasonic wave. Then, the ultrasonic dispersion treatment is continued for an additional 60 seconds. The temperature of water in the water tank is appropriately adjusted so as to be 10° C. or more and 40° C. or less upon ultrasonic dispersion.

(6) The electrolyte solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight-average particle diameter (D4) and the number-average particle diameter (D1) are calculated. The "Average Diameter" on the "Analysis/Volume Statistics (Arithmetic Average)" screen of the dedicated software when the dedicated software is set to show a graph in a vol % unit is the weight-average particle diameter (D4), and the "Average Diameter" on the "Analysis/Number Statistics (Arithmetic Average)" screen of the dedicated software when the dedicated software is set to show a graph in a number % unit is the number-average particle diameter (D1).

<Method of calculating Fine Powder Amount>

A fine powder amount (number %) on a number basis in the toner is calculated as described below.

For example, the number % of particles each having a particle diameter of 4.00 μm or less in the toner is calculated by the following procedure. After the measurement with the Multisizer 3, (1) the chart for the results of the measurement is displayed in terms of number % by setting the dedicated software to "graph/number %." (2) A check mark is placed in "<" of the particle diameter-setting portion in the "Format/Particle Diameter/Particle Diameter Statistics" screen, and "4" is input in the particle diameter-inputting portion below the particle diameter-setting portion. Then, (3) the numerical value in the "<4 μm" display portion when the "Analysis/Number Statistics (Arithmetic Average)" screen is displayed is the number % of the particles each having a particle diameter of 4.00 μm or less in the toner.

<Method of Calculating Coarse Powder Amount>

A coarse powder amount (vol %) on a volume basis in the toner is calculated by the following procedure.

For example, the volt of particles each having a particle diameter of 10.0 μm or more in the toner is calculated by the following procedure. After the measurement with the Multisizer 3, (1) the chart for the results of the measurement is displayed in terms of volt by setting the dedicated software to "graph/volt." (2) A check mark is placed in ">" of the particle diameter-setting portion in the "Format/Particle Diameter/Particle Diameter Statistics" screen, and "10" is input in the particle diameter-inputting portion below the particle diameter-setting portion. Then, (3) the numerical value in the ">10 μm" display portion when the "Analysis/Volume Statistics (Arithmetic Average)" screen is displayed is the volt of the particles each having a particle diameter of 10.0 μm or more in the toner.

<Method of Measuring Moisture Percentage Change of Magnetic Carrier>

A magnetic carrier is loaded onto a stainless-steel dish and 10 g thereof is weighed with a precision balance. The weighed carrier is left to stand in a decompressed drying machine at a preset temperature of 60° C. for 5 hours. A carrier mass at this time is defined as W1. After that, the resultant magnetic carrier is left to stand under an atmosphere having a temperature of 30° C. and a humidity of 80% RH for 24 hours. A carrier mass at this time is defined as W2. In addition, the moisture percentage of the magnetic carrier at this time is defined as A. After that, the carrier is subsequently left to stand under an environment having a temperature of 23° C. and a humidity of 5% RH for 24 hours. A carrier mass at this time is defined as W3. In addition, the moisture percentage of the magnetic carrier at this time is defined as B. The moisture percentage change of the magnetic carrier was calculated in accordance with the following equation (1).

$$\text{Moisture percentage change of magnetic carrier (mass \%)} = [(W2-W1)\times 100/W1]-[(W3-W1)\times 100/W1] = [A]-[B] \quad \text{(Equation 1)}$$

<Method of Measuring Thickness of Surface Resin Layer of Magnetic Carrier>

With regard to a method of measuring the thickness of each of the intermediate resin layer and the surface resin layer, a section of the magnetic carrier was observed with a transmission electron microscope (TEM) (at a magnification of 50,000, respectively), and the thickness of a coating layer was measured. Specifically, 100 particles of the magnetic carrier were prepared, and the thicknesses of the surface resin layer of a section of each particle of the magnetic carrier were measured at 10 arbitrary points. The minimum and maximum of the thicknesses of the surface resin layer were selected, and were defined as the minimum thickness (μm) and the maximum thickness (μm), respectively. In addition, in the thicknesses of the intermediate resin layer, the minimum thickness (μm) and the maximum thickness (μm) were measured by the same method. In the magnetic carrier of the present invention, the intermediate resin layer and the surface resin layer can be identified even by the measurement method because the intermediate resin layer and the surface resin layer differ from each other in kind and amount of particles to be incorporated.

<Method of Measuring Surface Functional Group Concentration of Particle (Hydrophilic-Treated Particle)>

Method of Measuring Carboxyl Group Concentration

10 Milligrams of particles are attached onto an indium foil. At that time, the particles are uniformly attached so that the indium foil portion may not be exposed. 1.0 Milliliter of 2,2,2-trifluoroethanol is dropped in a 30-milliliter screw tubular bottle, and the inside of the system is saturated with vapor. The particles are loaded into the system together with the indium foil, and the particles are left to stand for 12 hours in a state of being exposed to the 2,2,2-trifluoroethanol atmosphere. At this time, attention is paid so that the particles may not directly adhere to the 2,2,2-trifluoroethanol liquid. The particles were taken out of the inside of the system together with the indium foil, and were left to stand in a decompressed drying machine at a preset temperature of 25° C. for 6 hours. When XPS analysis was performed on each of the resultant particles, a $C_{15}$ XPS peak (P1) derived from a 2,2,2-trifluoroethyl ester and the XPS peak (P2) of an element derived from the particle were detected, and hence the surface functional group concentration of the particle was calculated in accordance with the following equation (2). Measurement conditions are as described below.

Apparatus: PHI 5000 VERSAPROBE II (manufactured by Ulvac-phi, Inc.)

Irradiated radiation: Al Kd radiation

Output: 25 W 15 kV

PassEnergy: 29.35 eV

Stepsize: 0.125 eV

XPS peak (P2): $C_{18}$ (CB), $Ti_{2P}$ ($TiO_2$, $SrTiO_2$), $Al_{2P}$ ($Al_2O_3$), $Mg_{2P}$ (MgO), $Zn_{2P3/2}$ (ZnO), $Si_{2P}$ ($SiO_2$)

$$\text{Surface functional group concentration of particle [\%]} = P1/P2 \times 100 \quad \text{(Equation 2)}$$

Method of Measuring Carbonyl Group Concentration

XPS analysis was performed by the same method as that in the measurement of the carboxyl group concentration except that the reaction reagent was changed from 2,2,2-trifluoroethanol to a diamine. A $N_{13}$ XPS peak (P3) derived from an imino group was detected, and hence the surface functional group concentration of a particle was calculated in accordance with the following equation (3).

$$\text{Surface functional group concentration of particle [\%]} = P3/P2 \times 100 \quad \text{(Equation 3)}$$

<Measurement of Pore Diameters and Total Pore Volume of Porous Magnetic Core Particles>

The pore diameter distribution of the porous magnetic core particles is measured by a mercury intrusion porosimetry.

A measurement principle is as described below.

In the measurement, a pressure to be applied to mercury is changed and the amount of mercury that infiltrates a pore at the pressure is measured. The condition under which mercury can infiltrate the pore can be represented by the following equation in consideration of the equilibrium of forces:

$$PD = -4\sigma \cos\theta$$

where P represents a pressure, D represents the diameter of the pore, and θ and σ represent the contact angle and surface tension of mercury, respectively. When the contact angle and the surface tension are constants, the pressure P and the diameter D of the pore which mercury can infiltrate at the pressure are inversely proportional to each other. In view of the foregoing, a pore distribution is determined by automatically replacing the axis of abscissa P of a P-V curve, which is obtained by measuring the amount V of the liquid to infiltrate at the pressure P while changing the pressure, with the pore diameter based on the equation.

The measurement can be performed with a measuring apparatus, such as a fully automatic multifunctional mercury porosimeter PoreMaster series/PozeMaster-GT series manufactured by Quantachrome Instruments (formerly Yuasa Ionics) or an automatic porosimeter Autopore IV9500 series manufactured by Shimadzu Corporation.

Specifically, the measurement was performed with Autopore IV9520 manufactured by Shimadzu Corporation under the following conditions by the following procedure.

Measurement Conditions

Measurement environment: 20° C.

Measurement cell: sample volume: 5 $cm^3$, penetration volume: 1.1 $cm^3$, application: for powder Measuring range: 2.0 psia (13.8 kPa) or more and 59,989.6 psia (413.7 MPa) or less Measuring step: 80 steps (steps are provided so as to be arranged at an equal interval when the pore diameter is represented on a logarithmic scale)

Penetration parameter:

Exhaust pressure: 50 μmHg

Exhaust period: 5.0 min

Mercury injection pressure: 2.0 psia (13.8 kPa)

Equilibrium time: 5 secs

High-pressure parameter:

Equilibrium time: 5 secs

Mercury parameter:

Advancing contact angle: 130.0 degrees

Receding contact angle: 130.0 degrees

Surface tension: 485.0 mN/m (485.0 dynes/cm)

Mercury density: 13.5335 g/mL

Measurement Procedure (1) About 1.0 g of the porous magnetic core particles are weighed and loaded into a sample cell.

The weighing value is input.

(2) The particles at a low pressure portion within a range of from 2.0 psia (13.8 kPa) or more to 45.8 psia (315.6 kPa) or less are measured.

(3) The particles at a high pressure portion within a range of from 45.9 psia (316.3 kPa) or more to 59,989.6 psia (413.6 kPa) or less are measured.

(4) A pore size distribution is calculated from a mercury injection pressure and a mercury injection amount.

The steps (2), (3), and (4) were automatically performed with the software included with the apparatus.

The pore diameter at which a differential pore volume in the pore diameter range of from 0.1 μm or more to 3.0 μm or less becomes maximum is read from the pore diameter distribution measured as described above, and the diameter is defined as the pore diameter at which the differential pore volume becomes local maximum.

In addition, a total pore volume obtained by integrating the differential pore volume in the pore diameter range of from 0.1 μm or more to 3.0 μm or less was calculated with software included with the apparatus.

<Method of Measuring True Density of Each of Magnetic Carrier and Carrier Core (Magnetic Core Particle)>

A true density was measured with a dry automatic densimeter AUTOPYCNOMETER (manufactured by Quantachrome Instruments).

<Measurement of Specific Resistance of Magnetic Carrier Core Particle (Magnetic Core Particle)>

Figure 3A:
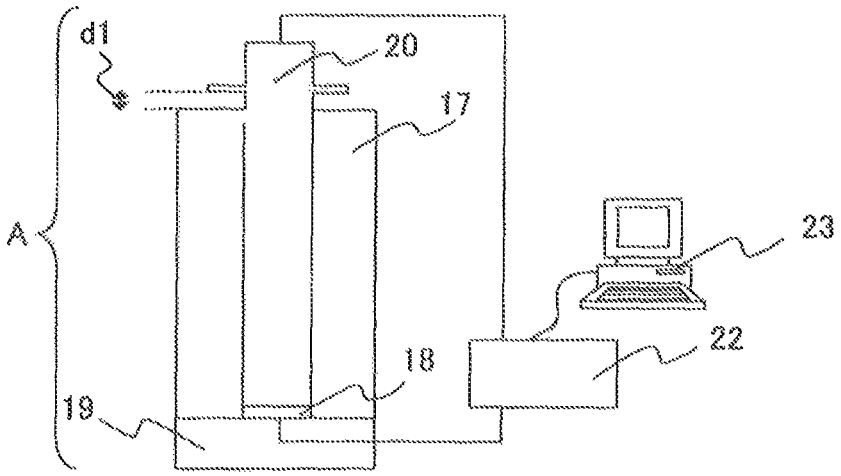
FIG. 3A is a schematic sectional view of an apparatus for measuring the specific resistance of a magnetic core, the figure being an illustration of a blank state before the loading of a sample.
Figure 3B:
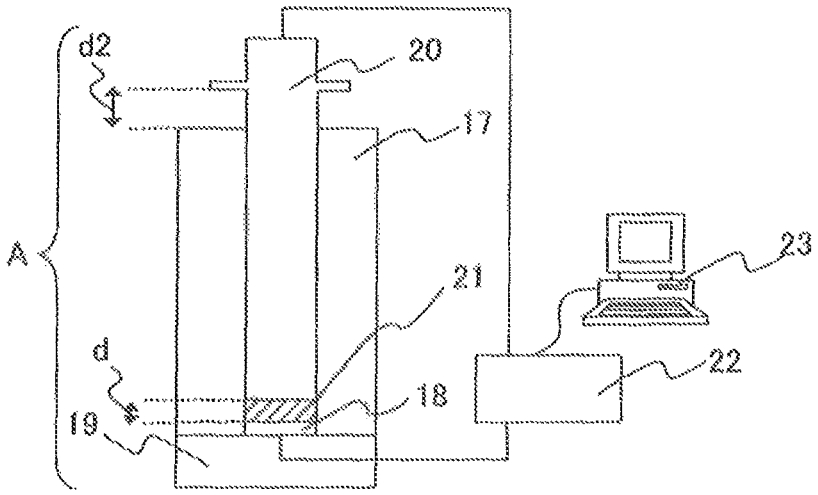
FIG. 3B is a schematic sectional view of the apparatus for measuring the specific resistance of the magnetic core, the figure being an illustration of a state when the sample is loaded.

The resistance of a magnetic carrier core particle is measured with a measuring apparatus schematically illustrated in each of FIG. 3A and FIG. 3B. A specific resistance at an electric field intensity of 300 (V/cm) is measured.

A resistance-measuring cell A includes a cylindrical container (made of a PTFE resin) 17 perforated with a hole having a sectional area of 2.4 $cm^2$, a lower electrode (made of stainless steel) 18, a supporting base (made of a PTFE resin) 19, and an upper electrode (made of stainless steel) 20. The cylindrical container 18 is mounted on the supporting base 19, and a sample 21 is loaded so as to have a thickness of about 1 mm. The upper electrode 20 is mounted on the loaded sample 21, and the thickness of the sample is measured. A gap when no sample is present as illustrated in FIG. 3A is defined as d1, and a gap when the sample is loaded so as to have a thickness of about 1 mm as illustrated in FIG. 3B is defined as d2. A thickness d of the sample is calculated from the following equation.

$$d = d2 - d1 \text{ (mm)}$$

At this time, the mass of the sample is appropriately changed so that the thickness d of the sample may be 0.95 mm or more and 1.04 mm or less.

The specific resistance of the sample can be determined by applying a DC voltage between the electrodes, and measuring an electric current flowing at the time. An electrometer 22 (KEITHLEY 6517A manufactured by Keithley Instruments) and a processing computer 23 for control are used in the measurement.

A control system manufactured by National Instruments and control software (LabVIEW manufactured by National Instruments) were used in the processing computer for control.

An area S of contact between the sample and the electrode of 2.4 $cm^2$ and the value d actually measured so that the thickness of the sample may be 0.95 mm or more and 1.04 mm or less are input as measurement conditions. In addition, the load of the upper electrode is set to 270 g and the maximum applied voltage is set to 1,000 V.

Specific resistance (Ω·cm)=(applied voltage (*V*)/measured electric current (*A*))×*S* ($cm^2$)/*d*(cm)

Electric field intensity (*V*/cm)=applied voltage (*V*)/*d* (cm)

The specific resistance of the magnetic carrier core particle at the electric field intensity is determined by reading a specific resistance at the electric field intensity on a graph from the graph.

<Method of Measuring Volume-Average Particle Diameter of Primary Particles of Inorganic Particles and Carbon Black (Treated Particles)>

The volume-average particle diameter of the primary particles of the inorganic particles and the carbon black in the present invention was determined as described below. A particle was observed with a transmission electron microscope, and the average of its long axis and short axis was defined as its particle diameter. In addition, the particle diameters of 100 particles were measured, and the average of the measured values was defined as the volume-average particle diameter of the primary particles.

EXAMPLE

Now, the present invention is described more specifically by way of Examples. However, the present invention is in no way limited to these Examples.

<Production Example of Porous Magnetic Core (Porous Magnetic Core Particle) 1>

Step 1 (Weighing and Mixing Step)

| | |
|---|---|
| $Fe_2O_3$ | 68.3 mass % |
| $MnCO_3$ | 28.5 mass % |
| $Mg(OH)_2$ | 2.0 mass % |
| $SrCO_3$ | 1.2 mass % |

The ferrite raw materials were weighed, and 20 parts by mass of water was added to 80 parts by mass of the ferrite raw materials. After that, the contents were subjected to wet mixing with a ball mill using zirconia balls each having a diameter (ϕ) of 10 mm for 3 hours to prepare a slurry. The solid content concentration of the slurry was set to 80 mass %.

Step 2 (Pre-Calcination Step)

The mixed slurry was dried with a spray dryer (manufactured by Ohkawara Kakohki Co., Ltd.), and was then calcined in a batch-type electric furnace under a nitrogen atmosphere (having an oxygen concentration of 1.0 volt) at a temperature of 1,050° C. for 3.0 hours to produce a pre-calcined ferrite.

Step 3 (Pulverization Step)

The pre-calcined ferrite was coarsely pulverized to about 0.5 mm with a crusher, and then water was added to the resultant. Thus, a coarsely pulverized slurry was prepared. The solid content concentration of the coarsely pulverized slurry was set to 70 mass %. The coarsely pulverized slurry was finely pulverized with a wet ball mill using stainless-steel beads each having a diameter of ⅛ inch for 3 hours to provide a finely pulverized slurry. Further, the finely pulverized slurry was pulverized with a wet bead mill using zirconia beads each having a diameter of 1 mm for 4 hours to provide a pre-calcined ferrite slurry having a 50% particle diameter (D50) on a volume basis of 1.3 μm.

Step 4 (Granulation Step)

An ammonium polycarboxylate serving as a dispersant and polyvinyl alcohol serving as a binder were added at ratios of 1.0 part by mass and 1.5 parts by mass, respectively to 100 parts by mass of the pre-calcined ferrite slurry, and then the mixture was granulated with a spray dryer (manufactured by Ohkawara Kakohki Co., Ltd.) into spherical particles and dried. The resultant granulated product was subjected to particle size adjustment, and then organic substances, such as the dispersant and the binder, were removed by heating the product with a rotary electric furnace at 700° C. for 2 hours.

Step 5 (Calcination Step)

The residue was calcined under a nitrogen atmosphere (having an oxygen concentration of 1.0 vol %) in a tunnel-type electric furnace as follows: a time required for the temperature of the residue to increase from room temperature to a calcination temperature (1,100° C.) was set to 2 hours, and the residue was held at a temperature of 1,100° C. for 4 hours. After that, the temperature was decreased to 60° C. over 8 hours and the nitrogen atmosphere was returned to the air, followed by the taking-out of the resultant at a temperature of 40° C. or less.

Step 6 (Sorting Step)

After aggregated particles had been disintegrated, coarse particles were removed by sifting with a sieve having an aperture of 150 μm, and fine powder was removed by air classification. Further, a low-magnetic force component was removed by magnetic separation. Thus, a porous magnetic core 1 was obtained. The resultant porous magnetic core 1 was porous and had pores. Production conditions for the respective steps of the resultant porous magnetic core 1 are shown in Table 1, and its respective physical property values are shown in Table 2.

TABLE 1

| | Step 2 | | Step 3 Pulverization step | | | Step 4 Granulation step | Step 5 Calcination step | | | | | Step 6 |
|---|---|---|---|---|---|---|---|---|---|---|---|---|
| | Pre-calcination step | | Pulverization Time (h) | | | Temperature at which organic | | Oxygen | Calcination | Temperature | | Sorting step |
| Magnetic core | Temperature (° C.) | Time (h) | Wet ball mill | Wet bead mill | D50 (μm) | substances are removed (° C.) | Calcination apparatus | concentration (vol %) | temperature (° C.) | increase time (h) | Holding time (h) | Aperture of sieve (μm) |
| Porous magnetic core 1 | 1,050 | 3.0 | 3.0 | 4.0 | 1.3 | 700 | Tunnel-type electric furnace | 1.0 | 1,100 | 2.0 | 4.0 | 150 |
| Porous magnetic core 2 | 1,050 | 3.0 | 3.0 | 4.0 | 1.3 | 700 | Tunnel-type electric furnace | 0.8 | 1,100 | 2.0 | 4.0 | 150 |
| Porous magnetic core 3 | 1,050 | 3.0 | 3.0 | 4.0 | 1.3 | 700 | Tunnel-type electric furnace | 1.1 | 1,100 | 2.0 | 4.0 | 150 |
| Porous magnetic core 4 | 1,050 | 3.0 | 3.0 | 5.0 | 1.2 | 700 | Tunnel-type electric furnace | 0.8 | 1,130 | 2.0 | 4.0 | 150 |
| Porous magnetic core 5 | 1,050 | 2.0 | 3.0 | 3.0 | 1.3 | 700 | Tunnel-type electric furnace | 1.1 | 1,100 | 2.3 | 3.9 | 150 |
| Porous magnetic core 6 | 1,050 | 3.0 | 3.0 | 5.0 | 1.2 | 700 | Tunnel-type electric furnace | 0.8 | 1,150 | 1.5 | 4.5 | 150 |
| Porous magnetic core 7 | 1,050 | 2.0 | 2.0 | 3.0 | 0.1 | 700 | Tunnel-type electric furnace | 1.2 | 1,020 | 2.4 | 3.8 | 150 |
| Porous magnetic core 8 | 1,050 | 3.0 | 4.0 | 5.0 | 1.0 | 700 | Tunnel-type electric furnace | 0.8 | 1,150 | 1.4 | 4.6 | 150 |
| Porous magnetic core 9 | 1,000 | 2.0 | 2.0 | 2.0 | 2.5 | 650 | Tunnel-type electric furnace | 1.3 | 1,020 | 2.5 | 4.0 | 250 |
| Porous magnetic core 10 | 1,050 | 3.0 | 4.0 | 5.0 | 1.0 | 700 | Tunnel-type electric furnace | 0.7 | 1,150 | 1.3 | 4.7 | 150 |
| Porous magnetic core 11 | 1,000 | 2.0 | 2.0 | 2.0 | 2.5 | 650 | Tunnel-type electric furnace | 1.4 | 1,020 | 2.6 | 4.0 | 250 |
| Porous magnetic core 12 | 1,050 | 3.0 | 4.0 | 5.0 | 1.0 | 700 | Tunnel-type electric furnace | 0.7 | 1,150 | 1.2 | 4.8 | 150 |
| Porous magnetic core 13 | 950 | 2.0 | 2.0 | 2.0 | 2.5 | 650 | Tunnel-type electric furnace | 1.4 | 900 | 2.7 | 4.0 | 250 |
| Magnetic core 1 | 950 | 2.0 | 2.0 | 3.0 | 2.1 | 700 | Tunnel-type electric furnace | 1.0 | 1,200 | 3.5 | 4.8 | 150 |
| Magnetic core 2 | 950 | 2.0 | 2.0 | 3.0 | 2.1 | 650 | Tunnel-type electric furnace | 1.1 | 1,200 | 3.0 | 4.5 | 150 |
| Magnetic core 3 | 950 | 2.0 | 2.0 | 3.0 | 2.1 | 650 | Tunnel-type electric furnace | 0.6 | 1,200 | 4.0 | 4.2 | 150 |
| Magnetic core 4 | 1,000 | 2.0 | 2.0 | 3.0 | 3.1 | 650 | Tunnel-type electric furnace | 0.5 | 1,150 | 3.5 | 5.0 | 150 |
| Magnetic core 5 | 1,050 | 2.0 | 4.0 | 5.0 | 2.5 | 700 | Tunnel-type electric furnace | 1.5 | 1,150 | 3.0 | 4.9 | 150 |
| Magnetic core 6 | 950 | 2.0 | 2.0 | 3.0 | 2.1 | 650 | Tunnel-type electric furnace | 1.0 | 1,200 | 4.0 | 5.0 | 150 |
| Magnetic core 7 | 950 | 2.0 | 2.0 | 3.0 | 2.1 | 650 | Tunnel-type electric furnace | 1.0 | 1,200 | 4.0 | 5.0 | 150 |

TABLE 2

| | D50 (μm) | Specific resistance at 300 V/cm (Ω · cm) | Mercury intrusion method: Pore diameter (μm) | Mercury intrusion method: Pore volume ($mm^3/g$) | True density (g/cc) |
|---|---|---|---|---|---|
| Porous magnetic core 1 | 37.7 | $2.0 \times 10^8$ | 0.65 | 65 | 3.81 |
| Porous magnetic core 2 | 37.2 | $3.5 \times 10^7$ | 0.70 | 64 | 4.02 |
| Porous magnetic core 3 | 34.9 | $7.5 \times 10^8$ | 0.71 | 61 | 3.92 |
| Porous magnetic core 4 | 45.0 | $2.1 \times 10^7$ | 0.61 | 50 | 4.10 |
| Porous magnetic core 5 | 60.5 | $8.1 \times 10^8$ | 0.76 | 80 | 3.95 |
| Porous magnetic core 6 | 34.2 | $1.9 \times 10^7$ | 0.51 | 20 | 4.20 |
| Porous magnetic core 7 | 65.8 | $8.7 \times 10^8$ | 0.88 | 100 | 3.71 |
| Porous magnetic core 8 | 35.4 | $1.9 \times 10^7$ | 0.49 | 19 | 4.15 |
| Porous magnetic core 9 | 75.2 | $9.0 \times 10^8$ | 0.90 | 101 | 3.60 |
| Porous magnetic core 10 | 33.6 | $9.6 \times 10^6$ | 0.40 | 18 | 3.51 |
| Porous magnetic core 11 | 76.0 | $1.6 \times 10^9$ | 1.00 | 102 | 4.21 |
| Porous magnetic core 12 | 33.1 | $9.1 \times 10^6$ | 0.39 | 22 | 3.69 |
| Porous magnetic core 13 | 76.8 | $2.0 \times 10^9$ | 1.01 | 99 | 4.20 |
| Magnetic core 1 | 38.0 | $8.5 \times 10^6$ | — | — | 4.89 |
| Magnetic core 2 | 45.0 | $5.3 \times 10^6$ | — | — | 5.01 |
| Magnetic core 3 | 41.0 | $8.5 \times 10^6$ | — | — | 5.20 |
| Magnetic core 4 | 39.4 | $4.5 \times 10^6$ | — | — | 4.82 |
| Magnetic core 5 | 42.9 | $9.0 \times 10^9$ | — | — | 4.75 |
| Magnetic core 6 | 53.6 | $7.7 \times 10^7$ | — | — | 4.99 |
| Magnetic core 7 | 54.6 | $6.5 \times 10^7$ | — | — | 5.05 |

<Production Examples of Porous Magnetic Cores 2 to 13 and Magnetic Cores (Ferrite Core Particles) 1 to 7>

Porous magnetic cores 2 to 13 and magnetic cores 1 to 7 were produced in the same manner as in the production example of the porous magnetic core 1 except that the production conditions for the respective steps were changed as shown in Table 1. The production conditions for the respective steps of the resultant porous magnetic cores 2 to 13, and the resultant magnetic cores 1 to 7 are shown in Table 1, and their respective physical property values are shown in Table 2.

<Production Example of Additive Particles (Hydrophilic-Treated Particles) 1>

Additive particles 1 were prepared as described below.

100 Parts by mass of carbon black (#4400, manufactured by Tokai Carbon Co., Ltd.) was loaded into a ground glass round-bottom flask having a capacity of 500 ml, and 200 parts by mass of an aqueous solution of nitric acid (50 mass %) was added to the flask. A ball-tipped condenser was connected to the flask, and the round-bottom flask was placed in a mantle heater, followed by the initiation of reflux. An oxidation treatment was performed for 30 minutes from the initiation. After the completion of the reflux, the carbon black was separated by filtration, and was dried in a drying machine at 125° C. to provide the additive particles 1. Treatment conditions for the resultant additive particles 1 and their respective physical property values are shown in Table 3. In Table 3, the abbreviation "CB" refers to carbon black.

<Production Examples of Additive Particles 2 to 5 and 7 to 13>

Additive particles 2 were prepared as described below.

100 Parts by mass of strontium titanate (trade name: SW-540, manufactured by Titan Kogyo, Ltd.) was loaded into a ground glass round-bottom flask having a capacity of 500 ml, and a nitrogen atmosphere was established in the system. After that, 300 parts by mass of anhydrous toluene was added to the flask. After the mixture had been cooled with ice, 5 parts by mass of triethylamine, 10 parts by mass of dimethylaminopyridine, and 10 parts by mass of acetic anhydride were added to the mixture, and the temperature of the whole was increased to 25° C., followed by stirring for 2 hours. 100 Parts by mass of a saturated aqueous solution of sodium hydrogen carbonate was added to the product obtained by the stirring to stop the reaction, and the resultant was washed with water and a toluene solvent, air-dried, and dried under reduced pressure to provide chemically modified particles.

100 Parts by mass of the resultant chemically modified particles were loaded into a ground glass round-bottom flask having a capacity of 500 ml, and 200 parts by mass of methanol was added to the flask. After the mixture had been cooled with ice, 30 parts by mass of calcium carbonate was added to the mixture, and the temperature of the whole was increased to 25° C., followed by stirring for 2 hours. 100 Parts by mass of a saturated aqueous solution of ammonium chloride was added to the product obtained by the stirring to stop the reaction, and the resultant was washed with water, air-dried, and dried under reduced pressure to provide the additive particles 2 serving as chemically modified particles.

In addition, additive particles 3 to 5 and 7 to 13 were obtained by performing the same treatment as that in the additive particles 2 except that the additive particle species (kind of the carbon black or the inorganic particles), and the kind and amount of the treatment agent were changed. Treatment conditions for the resultant additive particles 2 to 5 and 7 to 13, and their respective physical property values are shown in Table 3.

<Production Example of Additive Particles 6>

Additive particles 6 were prepared as described below.

100 Parts by mass of carbon black (#4400, manufactured by Tokai Carbon Co., Ltd.) was loaded into a tubular ozonization device. Subsequently, 3 parts by mass of ozone was generated with an ozone generator (KQS-120, manufactured by Kotohira Kogyo Co., Ltd.) per hour, and the oxidation treatment of the carbon black was performed for 2 hours under an ozone atmosphere while a treatment temperature was maintained at 40° C. Thus, the additive particles 6 were obtained. Treatment conditions for the resultant additive particles 6 and their respective physical property values are shown in Table 3.

<Production Examples of Additive Particles 14 and 16 to 23>

Additive particles 14 were prepared as described below.

100 Parts by mass of carbon black (#4400, manufactured by Tokai Carbon Co., Ltd.) was loaded into a ground glass round-bottom flask having a capacity of 500 ml, and a nitrogen atmosphere was established in the system. After that, 300 parts by mass of anhydrous toluene was added to the flask. After the mixture had been cooled with ice, 5 parts by mass of triethylamine, 10 parts by mass of dimethylaminopyridine, and 1.0 part by mass of alginic acid were added to the mixture, and the temperature of the whole was increased to 25° C., followed by stirring for 2 hours. 100 Parts by mass of a saturated aqueous solution of sodium hydrogen carbonate was added to the product obtained by the stirring to stop the reaction, and the resultant was washed with water and a toluene solvent, air-dried, and dried under reduced pressure to provide the additive particles 14.

In addition, additive particles 16 to 23 were obtained by performing the same treatment as that in the additive particles 14 except that the kind and amount of the treatment agent were changed. Treatment conditions for the resultant additive particles 14 and 16 to 23, and their respective physical property values are shown in Table 3.

<Additive Particles 15>

Carbon black (NEPOX505, manufactured by Evonik Degussa) in a state of not being subjected to any special treatment was used as additive particles 15. The respective physical property values of the additive particles 15 are shown in Table 3.

<Additive Particles 24>

Carbon black (#4400, manufactured by Tokai Carbon Co., Ltd.) in a state of not being subjected to any special treatment was used as additive particles 24. The respective physical property values of the additive particles 24 are shown in Table 3.

TABLE 3

| | Additive particle species | Functional group concentration (%) | Kind of functional group | Particle diameter (nm) | Kind of treatment | Treatment agent | Treatment amount (part(s) by mass) |
|---|---|---|---|---|---|---|---|
| Particles 1 | CB | 42 | Carboxyl group | 31 | Liquid phase oxidation method | Nitric acid | — |
| Particles 2 | $SrTiO_3$ | 55 | Carboxyl group | 72 | Carboxylation | Acetic anhydride | 10.0 |
| Particles 3 | $SiO_2$ | 31 | Carboxyl group | 35 | Carboxylation | Acetic anhydride | 10.0 |
| Particles 4 | $TiO_2$ | 64 | Carboxyl group | 61 | Carboxylation | Acetic anhydride | 10.0 |
| Particles 5 | $Al_2O_3$ | 71 | Carboxyl group | 55 | Carboxylation | Acetic anhydride | 10.0 |
| Particles 6 | CB | 32 | Carboxyl group | 31 | Vapor phase oxidation method | Ozone | — |
| Particles 7 | CB | 32 | Carboxyl group | 30 | Carboxylation | Acetic acid chloride | 20.0 |
| Particles 8 | CB | 42 | Carboxyl group | 38 | Carboxylation | Ethyl acetate | 15.0 |
| Particles 9 | $SrTiO_3$ | 21 | Carboxyl group | 79 | Carboxylation | Propionic anhydride | 20.0 |
| Particles 10 | MgO | 22 | Carboxyl group | 32 | Carboxylation | Succinic anhydride | 30.0 |
| Particles 11 | $TiO_2$ | 23 | Carboxyl group | 62 | Carboxylation | Maleic anhydride | 10.0 |
| Particles 12 | $Al_2O_3$ | 25 | Carboxyl group | 39 | Carboxylation | Phthalic anhydride | 10.0 |
| Particles 13 | $Al_2O_3$ | 27 | Carboxyl group | 47 | Carboxylation | Formic acid chloride | 10.0 |
| Particles 14 | CB | 20 | Ester group | 45 | Esterification | Alginic acid | 1.0 |
| Particles 15 | CB | 10 | Carboxyl group | 28 | — | — | — |
| Particles 16 | CB | 5 | Ester group | 29 | Esterification | Alginic anhydride | 5.0 |
| Particles 17 | CB | 5 | Ester group | 20 | Esterification | Ethyl acetate | 8.0 |
| Particles 18 | CB | 6 | Ester group | 26 | Esterification | Stearic acid | 5.0 |
| Particles 19 | CB | 10 | Ester group | 28 | Esterification | Lauric acid | 4.0 |
| Particles 20 | CB | 8 | Ester group | 37 | Esterification | Heptanoic acid | 7.0 |
| Particles 21 | CB | 12 | Ester group | 27 | Esterification | Nonanoic acid | 5.0 |
| Particles 22 | CB | 6 | Ester group | 26 | Esterification | Stearic acid | 5.0 |
| Particles 23 | CB | 5 | Ester group | 30 | Esterification | Stearic acid | 6.0 |
| Particles 24 | CB | 0 | — | 31 | — | — | — |

<Production Example of Magnetic Carrier 1>

Step 1 (Filling Step)

100 Parts by mass of the porous magnetic core 1 was loaded into the stirring vessel of a mixing-stirring machine (Universal Stirring Machine Model NDMV manufactured by Dalton Corporation). A temperature in the stirring vessel was maintained at 60° C., and nitrogen was introduced into the stirring vessel while a pressure in the stirring vessel was reduced to 2.3 kPa. Next, a resin solution was prepared by diluting 0.5 part by mass of γ-aminopropyltriethoxysilane and 20 parts by mass of a resin component 1 (see Table 4) with 79.5 parts by mass of toluene, and then the resin solution was dropped onto the porous magnetic core 1. Its dropping amount was adjusted so that the amount of the solid content (the resin component 1 and γ-aminopropyltriethoxysilane) of the resin component became 5.0 parts by mass with respect to 100 parts by mass of the magnetic core particles (the porous magnetic core 1).

Even after the completion of the dropping, stirring was continued without any change for 2.5 hours. After that, the temperature was increased to 70° C. and the solvent was removed under reduced pressure. Thus, a resin composition formed of the resin component 1 and γ-aminopropyltriethoxysilane was filled into the particles of the porous magnetic core 1.

After having been cooled, the resultant resin-filled magnetic core particles were transferred to a mixing machine having a spiral blade in a rotatable mixing vessel (Drum Mixer Model UD-AT manufactured by Suqiyama Heavy Industrial Co., Ltd.), and under a nitrogen atmosphere, the preset temperature of the stirring machine was increased to 220° C. at a rate of temperature increase of 2° C./min. The resin was cured by heating and stirring the particles at the temperature for 1.0 hour (stirring time at the time of the curing in Table 7-1). Further, the stirring was continued for 1.0 hour (holding time at the time of the curing in Table 7-1) while the temperature was held at 200° C.

After that, the temperature was cooled to room temperature, and ferrite particles in which the resin was filled and cured were taken out. A nonmagnetic product was removed with a magnetic separator. Further, coarse particles were removed with a vibrating sieve. Thus, resin-filled ferrite particles into which the resin was filled were obtained.

Step 2 (Intermediate Resin Layer Formation Step)

Under reduced pressure (1.5 kPa), the resultant resin-filled ferrite particles and a resin solution 9 shown in Table 5 were loaded into a planetary-screw mixing machine (Nauta Mixer Model VN manufactured by Hosokawa Micron Corporation) maintained at a temperature of 60° C. so that the amount of the solid content (solid resin free of any additive particle after the removal of a solvent) of a resin component became 0.8 part by mass with respect to 100 parts by mass of the resin-filled ferrite particles.

The loading was performed by the following procedure. First, the resin solution 9 was loaded in an amount corresponding to ⅓ of the total loading amount, and the removal of the solvent and an application operation were performed for 20 minutes. Next, the resin solution 9 was further loaded in an amount corresponding to ⅓ of the total loading amount, and the removal of the solvent and the application operation were performed for 20 minutes. Then, the resin solution 9 was further loaded in an amount corresponding to ⅓ of the total loading amount, and the removal of the solvent and the application operation were performed for 20 minutes to complete the loading of the total amount of the resin solution 9. Thus, the resin-filled ferrite particles were coated with a resin composition.

After that, the resin-filled ferrite particles coated with the resin composition were transferred to a mixing machine having a spiral blade in a rotatable mixing vessel (Drum Mixer Model UD-AT manufactured by Sugiyama Heavy industrial Co., Ltd.). Under a nitrogen atmosphere, the particles were subjected to a heat treatment at a temperature of 120° C. (coating apparatus temperature in Table 7-2) for 2 hours (treatment time in Table 7-2) while being stirred by rotating the mixing vessel 10 times per minute. A low-magnetic force article was separated from the resultant resin-filled ferrite particles after the heat treatment by magnetic separation, and the residue was passed through a sieve having an aperture of 150 μm and then classified with an air classifier. Thus, resin composition-coated particles were obtained.

Step 3 (Surface Resin Layer Formation Step)

Under reduced pressure (1.5 kPa), a resin solution 1 shown in Table 6 was loaded into a planetary-screw mixing machine (Nauta Mixer Model VN manufactured by Hosokawa Micron Corporation) maintained at a temperature of 60° C. so that the amount of the solid content (solid resin free of any additive particle after the removal of a solvent) of a resin component became 0.9 part by mass with respect to 100 parts by mass of the resin composition-coated particles.

The loading was performed by the following procedure. First, the resin solution 1 was loaded in an amount corresponding to ⅓ of the total loading amount, and the removal of the solvent and an application operation were performed for 20 minutes. Next, the resin solution 1 was further loaded in an amount corresponding to ⅓ of the total loading amount, and the removal of the solvent and the application operation were performed for 20 minutes. Then, the resin solution was further loaded in an amount corresponding to ⅓ of the total loading amount, and the removal of the solvent and the application operation were performed for 20 minutes to complete the loading of the entirety of the resin solution 1. Thus, a magnetic carrier coated with a resin composition was obtained.

After that, the magnetic carrier coated with the resin composition was transferred to a mixing machine having a spiral blade in a rotatable mixing vessel (Drum Mixer Model UD-AT manufactured by Sugiyama Heavy Industrial Co., Ltd.). Under a nitrogen atmosphere, the carrier was subjected to a heat treatment at a temperature of 120° C. (coating apparatus temperature in Table 7-3) for 2 hours (treatment time in Table 7-3) while being stirred by rotating the mixing vessel 10 times per minute. A low-magnetic force article was separated from the resultant magnetic carrier after the heat treatment by magnetic separation, and the residue was passed through a sieve having an aperture of 150 m and then classified with an air classifier. Thus, a magnetic carrier 1 was obtained.

Production conditions for the respective steps of the resultant magnetic carrier 1 are shown in Table 7-1 to Table 7-3, and its respective physical property values are shown in Table 8.

<Production Examples of Magnetic Carriers 2 to 33>

Further, magnetic carriers 2 to 11 and 13 to 33 were produced in the same manner as in the magnetic carrier 1 except that production conditions shown in Table 7-1 to Table 7-3 were adopted. Their respective physical property values are shown in Table 8.

Resin solutions 1 to 32 shown in Table 7-2 and Table 7-3 are shown in Table 5 and Table 6. In addition, the resin component 1 shown in Table 7-1, and resin components 2 and 3 shown in Table 6 are shown in Table 4. Herein, the term "EPOSTAR S" in each of Table 5 and Table 6 refers to a melamine-formaldehyde condensate (manufactured by Nippon Shokubai Co., Ltd.).

A magnetic carrier 12 was produced in the same manner as in the magnetic carrier 1 except that a coating step was changed as described below.

Step 2 (Intermediate Resin Layer Formation Step)

100 Parts by mass of the porous magnetic core 12 and 0.9 part by mass of the resin solid content of the resin solution 20 obtained as follows were loaded into NOBILTA (manufactured by Hosokawa Micron Corporation) serving as a stirring machine: a solvent was removed, and only the resin solid content was taken out and pulverized to have a weight-average particle diameter of 50 μm. As a premixing step, the core and the solid content were stirred and mixed at an outermost end peripheral speed of a stirring member of 1 m/s for 2 minutes. After that, a coating treatment was performed for 15 minutes while the speed was adjusted to 10 m/s. Thus, magnetic particles were obtained. A low-magnetic force article was separated from the resultant magnetic particles by magnetic separation, and the residue was passed through a sieve having an aperture of 150 μm and then classified with an air classifier. Thus, resin composition-coated particles were obtained.

Step 3 (Surface Resin Layer Coating Step)

Subsequently, 100 parts by mass of the above-mentioned resin composition-coated particles and 1.0 part by mass of the resin solid content of the resin solution 1 obtained as follows were loaded into NOBILTA (manufactured by Hosokawa Micron Corporation) serving as a stirring machine: a solvent was removed, and only the resin solid content was taken out and pulverized to have a weight-average particle diameter of 50 μm. As a premixing step, the particles and the solid content were stirred and mixed at an outermost end peripheral speed of a stirring member of 1 m/s for 2 minutes. After that, a coating treatment was performed for 15 minutes while the speed was adjusted to 10 m/s. Thus, a magnetic carrier was obtained. A low-magnetic force article was separated from the resultant magnetic carrier by magnetic separation, and the residue was passed through a sieve having an aperture of 150 μm and then classified with an air classifier. Thus, a magnetic carrier 12 was obtained.

Production conditions for the respective steps of the resultant magnetic carrier 12 are shown in Table 7-1 to Table 7-3, and its respective physical property values are shown in Table 8.

TABLE 4

| | Resin solid content<br>Kind of resin |
|---|---|
| Resin component 1 | SR2410<br>Manufactured by Dow Corning Toray Co., Ltd. |
| Resin component 2 | Polymethyl methacrylate polymer (Mw 85,000) |
| Resin component 3 | Cyclohexyl methacrylate<br>Methyl methacrylate macromonomer (Mw 5,000)<br>Methyl methacrylate copolymer |

The symbol "Mw" in Table 4 refers to a weight-average molecular weight.

TABLE 5

| | Resin | | | Additive particles | | | |
|---|---|---|---|---|---|---|---|
| Resin solution number | Resin component number | Amount of solvent content (part(s) by mass) | Amount of solvent (part(s) by mass) | EPOSTAR S (part(s) by mass) | Particle species | Particle species number | Addition amount (part(s) by mass) |
| Resin solution 9 | Resin component 2 | 40.0 | 59.0 | — | CB | Particles 1 | 1.0 |
| Resin solution 10 | Resin component 2 | 40.0 | 59.0 | — | $SrTiO_3$ | Particles 2 | 1.0 |
| Resin solution 11 | Resin component 2 | 40.0 | 59.0 | — | $SiO_2$ | Particles 3 | 1.0 |
| Resin solution 12 | Resin component 2 | 40.0 | 59.0 | — | $TiO_2$ | Particles 4 | 1.0 |
| Resin solution 13 | Resin component 2 | 40.0 | 59.0 | — | $Al_2O_3$ | Particles 5 | 1.0 |
| Resin solution 14 | Resin component 2 | 40.0 | 59.0 | — | CB | Particles 6 | 1.0 |
| Resin solution 15 | Resin component 2 | 40.0 | 59.0 | — | CB | Particles 7 | 1.0 |
| Resin solution 16 | Resin component 2 | 40.0 | 59.0 | — | CB | Particles 8 | 1.0 |
| Resin solution 17 | Resin component 2 | 40.0 | 59.0 | — | $SrTiO_3$ | Particles 9 | 1.0 |
| Resin solution 18 | Resin component 2 | 40.0 | 59.0 | — | MgO | Particles 10 | 1.0 |
| Resin solution 19 | Resin component 2 | 40.0 | 59.0 | — | $TiO_2$ | Particles 11 | 1.0 |
| Resin solution 20 | Resin component 2 | 40.0 | 59.0 | — | $Al_2O_3$ | Particles 12 | 1.0 |
| Resin solution 21 | Resin component 2 | 40.0 | 59.0 | — | $Al_2O_3$ | Particles 13 | 1.0 |
| Resin solution 22 | Resin component 2 | 40.0 | 59.0 | — | CB | Particles 14 | 1.0 |
| Resin solution 23 | Resin component 2 | 40.0 | 59.0 | — | CB | Particles 15 | 1.0 |

TABLE 5-continued

| | Resin | | | Additive particles | | | |
|---|---|---|---|---|---|---|---|
| Resin solution number | Resin component number | Amount of solvent content (part(s) by mass) | Amount of solvent (part(s) by mass) | EPOSTAR S (part(s) by mass) | Particle species | Particle species number | Addition amount (part(s) by mass) |
| Resin solution 24 | Resin component 2 | 40.0 | 59.0 | — | CB | Particles 16 | 1.0 |
| Resin solution 25 | Resin component 2 | 40.0 | 59.0 | — | CB | Particles 17 | 1.0 |
| Resin solution 26 | Resin component 2 | 40.0 | 59.0 | 1.00 | — | — | 0.0 |
| Resin solution 27 | Resin component 2 | 40.0 | 59.0 | — | CB | Particles 18 | 1.0 |
| Resin solution 28 | Resin component 2 | 40.0 | 59.0 | — | CB | Particles 19 | 1.0 |
| Resin solution 29 | Resin component 2 | 40.0 | 59.0 | — | CB | Particles 20 | 1.0 |
| Resin solution 30 | Resin component 2 | 40.0 | 59.0 | — | CB | Particles 21 | 1.0 |
| Resin solution 31 | Resin component 2 | 40.0 | 59.0 | — | CB | Particles 22 | 1.0 |
| Resin solution 32 | Resin component 2 | 40.0 | 59.0 | — | CB | Particles 23 | 1.0 |

The term "EPOSTAR S" in Table 5 refers to a melamine-formaldehyde condensate (manufactured by Nippon Shokubai Co., Ltd.).

TABLE 6

| | Resin | | | Additive | | Additive particles | | |
|---|---|---|---|---|---|---|---|---|
| Resin solution number | Resin component number | Amount of solid content in resin solution (part(s) by mass) | Amount of solvent (part(s) by mass) | EPOSTAR S (part(s) by mass) | γ-Amino-propyl-triethoxy silane | Particle species | Particle species number | Addition amount (part(s) by mass) |
| Resin solution 1 | Resin component 3 | 40.0 | 56.5 | 3.00 | 0.00 | CB | Particles 24 | 0.5 |
| Resin solution 2 | Resin component 2 | 40.0 | 56.5 | 3.00 | 0.00 | CB | Particles 24 | 0.5 |
| Resin solution 3 | Resin component 2 | 40.0 | 55.5 | 3.00 | 0.50 | CB | Particles 24 | 1.5 |
| Resin solution 4 | Resin component 2 | 40.0 | 56.5 | 3.00 | 0.50 | CB | Particles 1 | 0.5 |
| Resin solution 5 | Resin component 2 | 40.0 | 56.5 | 3.00 | 0.50 | $SiO_2$ | Particles 3 | 0.5 |
| Resin solution 6 | Resin component 2 | 40.0 | 56.5 | 3.00 | 0.50 | $SrTiO_3$ | Particles 2 | 0.5 |
| Resin solution 7 | Resin component 2 | 40.0 | 56.5 | 3.00 | 0.50 | $SiO_2$ | Particles 4 | 0.5 |
| Resin solution 8 | Resin component 2 | 40.0 | 56.5 | 3.00 | 0.50 | $Al_2O_3$ | Particles 5 | 0.5 |

The term "EPOSTAR S" in Table 6 refers to a melamine-formaldehyde condensate (manufactured by Nippon Shokubai Co, Ltd.).

TABLE 7-1

| | | Step 1 (filling step) | | | | | | |
|---|---|---|---|---|---|---|---|---|
| | | | | | At time of curing | | | |
| | Magnetic core | Resin component number | Solid content filling amount (part(s) by mass) | At time of filling Stirring time after dropping (h) | Preset temperature of stirring machine (° C.) | Stirring time (h) | Held temperature (° C.) | Holding time (h) |
| Magnetic carrier 1 | Porous magnetic core 1 | Resin component 1 | 5.0 | 2.5 | 220 | 1.0 | 200 | 1.0 |
| Magnetic carrier 2 | Porous magnetic core 2 | Resin component 1 | 5.0 | 2.5 | 120 | 1.0 | 120 | 1.0 |
| Magnetic carrier 3 | Porous magnetic core 3 | Resin component 1 | 5.0 | 2.5 | 220 | 1.0 | 200 | 1.0 |
| Magnetic carrier 4 | Porous magnetic core 4 | Resin component 1 | 4.0 | 2.5 | 220 | 1.0 | 200 | 1.0 |
| Magnetic carrier 5 | Porous magnetic core 5 | Resin component 1 | 6.0 | 2.0 | 220 | 1.0 | 200 | 1.0 |
| Magnetic carrier 6 | Porous magnetic core 6 | Resin component 1 | 3.0 | 2.7 | 220 | 1.0 | 200 | 1.0 |
| Magnetic carrier 7 | Porous magnetic core 7 | Resin component 1 | 8.0 | 1.5 | 100 | 1.0 | 100 | 2.0 |
| Magnetic carrier 8 | Porous magnetic core 8 | Resin component 1 | 2.0 | 3.0 | 220 | 1.0 | 200 | 1.0 |
| Magnetic carrier 9 | Porous magnetic core 9 | Resin component 1 | 9.0 | 1.5 | 220 | 1.0 | 200 | 1.0 |
| Magnetic carrier 10 | Porous magnetic core 10 | Resin component 1 | 2.0 | 3.0 | 220 | 1.0 | 200 | 1.0 |
| Magnetic carrier 11 | Porous magnetic core 11 | Resin component 1 | 9.0 | 1.5 | 100 | 1.0 | 100 | 2.0 |
| Magnetic carrier 12 | Porous magnetic core 12 | Resin component 1 | 3.0 | 2.5 | 220 | 1.0 | 200 | 1.0 |
| Magnetic carrier 13 | Magnetic core 1 | — | — | — | — | — | — | — |
| Magnetic carrier 14 | Porous magnetic core 13 | Resin component 1 | 7.5 | 3.0 | 220 | 1.0 | 200 | 1.0 |
| Magnetic carrier 15 | Magnetic core 2 | — | — | — | — | — | — | — |
| Magnetic carrier 16 | Magnetic core 3 | — | — | — | — | — | — | — |
| Magnetic carrier 17 | Magnetic core 4 | — | — | — | — | — | — | — |
| Magnetic carrier 18 | Magnetic core 5 | — | — | — | — | — | — | — |
| Magnetic carrier 19 | Magnetic core 6 | — | — | — | — | — | — | — |
| Magnetic carrier 20 | Magnetic core 7 | — | — | — | — | — | — | — |
| Magnetic carrier 21 | Magnetic core 1 | — | — | — | — | — | — | — |
| Magnetic carrier 22 | Magnetic core 1 | — | — | — | — | — | — | — |
| Magnetic carrier 23 | Magnetic core 1 | — | — | — | — | — | — | — |
| Magnetic carrier 24 | Magnetic core 1 | — | — | — | — | — | — | — |
| Magnetic carrier 25 | Magnetic core 1 | — | — | — | — | — | — | — |
| Magnetic carrier 26 | Magnetic core 1 | — | — | — | — | — | — | — |
| Magnetic carrier 27 | Magnetic core 1 | — | — | — | — | — | — | — |
| Magnetic carrier 28 | Porous magnetic core 1 | Resin component 1 | 5.0 | 2.5 | 220 | 1.0 | 200 | 1.0 |
| Magnetic carrier 29 | Magnetic core 1 | — | — | — | — | — | — | — |
| Magnetic carrier 30 | Magnetic core 1 | — | — | — | — | — | — | — |
| Magnetic carrier 31 | Magnetic core 1 | — | — | — | — | — | — | — |
| Magnetic carrier 32 | Magnetic core 1 | — | — | — | — | — | — | — |

TABLE 7-1-continued

| | | Step 1 (filling step) | | | | | | |
|---|---|---|---|---|---|---|---|---|
| | | | | | At time of curing | | | |
| | Magnetic core | Resin component number | Solid content filling amount (part(s) by mass) | At time of filling Stirring time after dropping (h) | Preset temperature of stirring machine (° C.) | Stirring time (h) | Held temperature (° C.) | Holding time (h) |
| Magnetic carrier 33 | Magnetic core 1 | — | — | — | — | — | — | — |

TABLE 7-2

| | | Step 2 (intermediate resin layer formation step) | | | | | |
|---|---|---|---|---|---|---|---|
| | Magnetic core | Resin solution | Solid content coating amount (part(s) by mass) | Coating method | Coating apparatus temperature (° C.) | Treatment time (h) | Aperture of sieve (μm) |
| Magnetic carrier 1 | Porous magnetic core 1 | Resin solution 9 | 0.8 | Wet method | 120 | 2.0 | 150 |
| Magnetic carrier 2 | Porous magnetic core 2 | Resin solution 10 | 1.0 | Wet method | 120 | 2.0 | 150 |
| Magnetic carrier 3 | Porous magnetic core 3 | Resin solution 11 | 0.6 | Wet method | 120 | 2.0 | 150 |
| Magnetic carrier 4 | Porous magnetic core 4 | Resin solution 12 | 0.8 | Wet method | 120 | 2.0 | 150 |
| Magnetic carrier 5 | Porous magnetic core 5 | Resin solution 13 | 1.0 | Wet method | 120 | 2.0 | 150 |
| Magnetic carrier 6 | Porous magnetic core 6 | Resin solution 14 | 0.9 | Wet method | 120 | 2.0 | 150 |
| Magnetic carrier 7 | Porous magnetic core 7 | Resin solution 15 | 0.8 | Wet method | 120 | 2.0 | 150 |
| Magnetic carrier 8 | Porous magnetic core 8 | Resin solution 16 | 0.7 | Wet method | 120 | 2.0 | 150 |
| Magnetic carrier 9 | Porous magnetic core 9 | Resin solution 17 | 1.1 | Wet method | 120 | 2.0 | 150 |
| Magnetic carrier 10 | Porous magnetic core 10 | Resin solution 18 | 1.1 | Wet method | 120 | 2.0 | 150 |
| Magnetic carrier 11 | Porous magnetic core 11 | Resin solution 19 | 0.9 | Wet method | 120 | 2.0 | 150 |
| Magnetic carrier 12 | Porous magnetic core 12 | Resin solution 20 | 0.9 | Dry method | 120 | 2.0 | 150 |
| Magnetic carrier 13 | Magnetic core 1 | Resin solution 21 | 0.7 | Wet method | 120 | 2.0 | 150 |
| Magnetic carrier 14 | Porous magnetic core 13 | Resin solution 22 | 0.9 | Wet method | 120 | 2.0 | 250 |
| Magnetic carrier 15 | Magnetic core 2 | Resin solution 23 | 0.7 | Wet method | 120 | 2.0 | 150 |
| Magnetic carrier 16 | Magnetic core 3 | Resin solution 24 | 0.7 | Wet method | 120 | 2.0 | 250 |
| Magnetic carrier 17 | Magnetic core 4 | Resin solution 25 | 0.3 | Wet method | 120 | 2.0 | 150 |
| Magnetic carrier 18 | Magnetic core 5 | Resin solution 25 | 1.3 | Wet method | 120 | 2.0 | 250 |
| Magnetic carrier 19 | Magnetic core 6 | Resin solution 25 | 0.2 | Wet method | 120 | 2.0 | 150 |
| Magnetic carrier 20 | Magnetic core 7 | Resin solution 25 | 1.3 | Wet method | 120 | 2.0 | 150 |
| Magnetic carrier 21 | Magnetic core 1 | Resin solution 25 | 1.1 | Wet method | 120 | 2.0 | 150 |
| Magnetic carrier 22 | Magnetic core 1 | Resin solution 26 | 1.2 | Wet method | 120 | 2.0 | 150 |
| Magnetic carrier 23 | Magnetic core 1 | Resin solution 27 | 1.1 | Wet method | 120 | 2.0 | 150 |
| Magnetic carrier 24 | Magnetic core 1 | Resin solution 28 | 1.1 | Wet method | 120 | 2.0 | 150 |
| Magnetic carrier 25 | Magnetic core 1 | Resin solution 29 | 1.1 | Wet method | 120 | 2.0 | 150 |
| Magnetic carrier 26 | Magnetic core 1 | Resin solution 30 | 1.4 | Wet method | 120 | 2.0 | 150 |

TABLE 7-2-continued

| | | Step 2 (intermediate resin layer formation step) | | | | | |
|---|---|---|---|---|---|---|---|
| | Magnetic core | Resin solution | Solid content coating amount (part(s) by mass) | Coating method | Coating apparatus temperature (° C.) | Treatment time (h) | Aperture of sieve (μm) |
| Magnetic carrier 27 | Magnetic core 1 | Resin solution 31 | 1.2 | Wet method | 120 | 2.0 | 150 |
| Magnetic carrier 28 | Porous magnetic core 1 | Resin solution 32 | 1.3 | Wet method | 120 | 2.0 | 150 |
| Magnetic carrier 29 | Magnetic core 1 | Resin solution 32 | 1.3 | Wet method | 200 | 2.0 | 150 |
| Magnetic carrier 30 | Magnetic core 1 | Resin solution 32 | 1.4 | Wet method | 200 | 2.0 | 200 |
| Magnetic carrier 31 | Magnetic core 1 | Resin solution 32 | 1.4 | Wet method | 200 | 2.0 | 200 |
| Magnetic carrier 32 | Magnetic core 1 | Resin solution 32 | 1.3 | Wet method | 200 | 2.0 | 250 |
| Magnetic carrier 33 | Magnetic core 1 | Resin solution 32 | 1.3 | Wet method | 200 | 2.0 | 250 |

TABLE 7-3

| | | Step 3 (surface resin layer formation step) | | | | | |
|---|---|---|---|---|---|---|---|
| | Magnetic core | Resin solution | Solid content coating amount (part(s) by mass) | Coating method | Coating apparatus temperature (° C.) | Treatment time (h) | Aperture of sieve (μm) |
| Magnetic carrier 1 | Porous magnetic core 1 | Resin solution 1 | 0.9 | Wet method | 120 | 2.0 | 150 |
| Magnetic carrier 2 | Porous magnetic core 2 | Resin solution 1 | 1.0 | Wet method | 120 | 2.0 | 150 |
| Magnetic carrier 3 | Porous magnetic core 3 | Resin solution 1 | 0.6 | Wet method | 120 | 2.0 | 150 |
| Magnetic carrier 4 | Porous magnetic core 4 | Resin solution 1 | 0.8 | Wet method | 120 | 2.0 | 150 |
| Magnetic carrier 5 | Porous magnetic core 5 | Resin solution 1 | 1.0 | Wet method | 120 | 2.0 | 150 |
| Magnetic carrier 6 | Porous magnetic core 6 | Resin solution 1 | 0.8 | Wet method | 120 | 2.0 | 150 |
| Magnetic carrier 7 | Porous magnetic core 7 | Resin solution 1 | 0.9 | Wet method | 120 | 2.0 | 150 |
| Magnetic carrier 8 | Porous magnetic core 8 | Resin solution 1 | 0.9 | Wet method | 120 | 2.0 | 150 |
| Magnetic carrier 9 | Porous magnetic core 9 | Resin solution 1 | 0.9 | Wet method | 120 | 2.0 | 150 |
| Magnetic carrier 10 | Porous magnetic core 10 | Resin solution 1 | 0.8 | Wet method | 120 | 2.0 | 150 |
| Magnetic carrier 11 | Porous magnetic core 11 | Resin solution 1 | 0.8 | Wet method | 120 | 2.0 | 150 |
| Magnetic carrier 12 | Porous magnetic core 12 | Resin solution 1 | 1.0 | Dry method | 120 | 2.0 | 150 |
| Magnetic carrier 13 | Magnetic core 1 | Resin solution 1 | 0.6 | Wet method | 120 | 2.0 | 150 |
| Magnetic carrier 14 | Porous magnetic core 13 | Resin solution 1 | 1.1 | Wet method | 120 | 2.0 | 250 |
| Magnetic carrier 15 | Magnetic core 2 | Resin solution 1 | 0.6 | Wet method | 120 | 2.0 | 150 |
| Magnetic carrier 16 | Magnetic core 3 | Resin solution 2 | 0.5 | Wet method | 120 | 2.0 | 250 |
| Magnetic carrier 17 | Magnetic core 4 | Resin solution 2 | 0.2 | Wet method | 120 | 2.0 | 150 |
| Magnetic carrier 18 | Magnetic core 5 | Resin solution 2 | 1.3 | Wet method | 120 | 2.0 | 250 |
| Magnetic carrier 19 | Magnetic core 6 | Resin solution 2 | 0.1 | Wet method | 120 | 2.0 | 150 |
| Magnetic carrier 20 | Magnetic core 7 | Resin solution 2 | 1.4 | Wet method | 120 | 2.0 | 150 |
| Magnetic carrier 21 | Magnetic core 1 | Resin solution 2 | 1.2 | Wet method | 120 | 2.0 | 150 |

TABLE 7-3-continued

| | | Step 3 (surface resin layer formation step) | | | | | |
|---|---|---|---|---|---|---|---|
| | Magnetic core | Resin solution | Solid content coating amount (part(s) by mass) | Coating method | Coating apparatus temperature (° C.) | Treatment time (h) | Aperture of sieve (μm) |
| Magnetic carrier 22 | Magnetic core 1 | Resin solution 3 | 1.2 | Wet method | 120 | 2.0 | 150 |
| Magnetic carrier 23 | Magnetic core 1 | Resin solution 2 | 1.3 | Wet method | 120 | 2.0 | 150 |
| Magnetic carrier 24 | Magnetic core 1 | Resin solution 2 | 1.3 | Wet method | 120 | 2.0 | 150 |
| Magnetic carrier 25 | Magnetic core 1 | Resin solution 2 | 1.3 | Wet method | 120 | 2.0 | 150 |
| Magnetic carrier 26 | Magnetic core 1 | Resin solution 2 | 1.4 | Wet method | 120 | 2.0 | 150 |
| Magnetic carrier 27 | Magnetic core 1 | — | 0.0 | — | — | — | — |
| Magnetic carrier 28 | Porous magnetic core 1 | Resin solution 4 | 1.3 | Wet method | 120 | 2.0 | 150 |
| Magnetic carrier 29 | Magnetic core 1 | Resin solution 4 | 1.3 | Wet method | 120 | 2.0 | 150 |
| Magnetic carrier 30 | Magnetic core 1 | Resin solution 5 | 1.4 | Wet method | 120 | 2.0 | 200 |
| Magnetic carrier 31 | Magnetic core 1 | Resin solution 6 | 1.5 | Wet method | 120 | 2.0 | 200 |
| Magnetic carrier 32 | Magnetic core 1 | Resin solution 7 | 1.2 | Wet method | 120 | 2.0 | 250 |
| Magnetic carrier 33 | Magnetic core 1 | Resin solution 8 | 1.3 | Wet method | 120 | 2.0 | 250 |

TABLE 8

| | | | Intermediate resin layer | | Surface resin layer | | Moisture | |
|---|---|---|---|---|---|---|---|---|
| | | Magnetic core | Minimum thickness (μm) | Maximum thickness (μm) | Minimum thickness (μm) | Maximum thickness (μm) | percentage change (mass %) | D50 (μm) |
| Example 1 | Magnetic carrier 1 | Porous magnetic core 1 | 1.00 | 1.00 | 0.80 | 1.20 | 0.006 | 39.1 |
| Example 2 | Magnetic carrier 2 | Porous magnetic core 2 | 0.80 | 1.30 | 1.00 | 1.10 | 0.009 | 41.6 |
| Example 3 | Magnetic carrier 3 | Porous magnetic core 3 | 0.60 | 1.40 | 0.80 | 1.30 | 0.011 | 38.3 |
| Example 4 | Magnetic carrier 4 | Porous magnetic core 4 | 0.70 | 1.30 | 0.90 | 1.20 | 0.009 | 35.2 |
| Example 5 | Magnetic carrier 5 | Porous magnetic core 5 | 0.80 | 1.00 | 0.70 | 1.20 | 0.011 | 38.9 |
| Example 6 | Magnetic carrier 6 | Porous magnetic core 6 | 0.90 | 1.10 | 1.20 | 1.30 | 0.009 | 35.9 |
| Example 7 | Magnetic carrier 7 | Porous magnetic core 7 | 0.60 | 1.50 | 0.60 | 1.20 | 0.012 | 38.1 |
| Example 8 | Magnetic carrier 8 | Porous magnetic core 8 | 0.80 | 1.00 | 0.80 | 1.10 | 0.007 | 41.6 |
| Example 9 | Magnetic carrier 9 | Porous magnetic core 9 | 0.80 | 1.20 | 1.10 | 1.20 | 0.014 | 47.7 |
| Example 10 | Magnetic carrier 10 | Porous magnetic core 10 | 0.90 | 1.00 | 1.10 | 1.30 | 0.018 | 62.3 |
| Example 11 | Magnetic carrier 11 | Porous magnetic core 11 | 1.00 | 1.00 | 1.20 | 1.40 | 0.017 | 34.9 |
| Example 12 | Magnetic carrier 12 | Porous magnetic core 12 | 0.90 | 1.10 | 0.90 | 1.50 | 0.020 | 66.6 |
| Example 13 | Magnetic carrier 13 | Magnetic core 1 | 0.80 | 1.20 | 0.80 | 1.20 | 0.019 | 36.1 |
| Example 14 | Magnetic carrier 14 | Porous magnetic core 13 | 0.70 | 1.30 | 0.30 | 1.90 | 0.021 | 76.4 |
| Example 15 | Magnetic carrier 15 | Magnetic core 2 | 0.90 | 1.00 | 0.40 | 1.70 | 0.021 | 34.0 |
| Example 16 | Magnetic carrier 16 | Magnetic core 3 | 0.90 | 1.10 | 0.10 | 1.50 | 0.025 | 76.8 |
| Example 17 | Magnetic carrier 17 | Magnetic core 4 | 0.80 | 1.30 | 0.01 | 0.10 | 0.028 | 33.7 |

TABLE 8-continued

| | | | Intermediate resin layer | | Surface resin layer | | Moisture | |
|---|---|---|---|---|---|---|---|---|
| | | Magnetic core | Minimum thickness (μm) | Maximum thickness (μm) | Minimum thickness (μm) | Maximum thickness (μm) | percentage change (mass %) | D50 (μm) |
| Example 18 | Magnetic carrier 18 | Magnetic core 5 | 0.80 | 1.20 | 4.00 | 4.00 | 0.029 | 77.2 |
| Example 19 | Magnetic carrier 19 | Magnetic core 6 | 0.70 | 1.30 | 0.01 | 0.09 | 0.030 | 38.3 |
| Example 20 | Magnetic carrier 20 | Magnetic core 7 | 0.80 | 1.30 | 4.00 | 4.00 | 0.030 | 47.1 |
| Comparative Example 1 | Magnetic carrier 21 | Magnetic core 1 | 0.90 | 1.00 | 4.00 | 4.00 | 0.039 | 49.6 |
| Comparative Example 2 | Magnetic carrier 22 | Magnetic core 1 | 0.90 | 1.10 | 4.00 | 4.00 | 0.033 | 44.2 |
| Comparative Example 3 | Magnetic carrier 23 | Magnetic core 1 | 0.90 | 1.10 | 4.00 | 4.00 | 0.041 | 40.7 |
| Comparative Example 4 | Magnetic carrier 24 | Magnetic core 1 | 0.90 | 1.00 | 4.00 | 4.00 | 0.069 | 42.9 |
| Comparative Example 5 | Magnetic carrier 25 | Magnetic core 1 | 0.80 | 1.10 | 4.00 | 4.00 | 0.058 | 39.9 |
| Comparative Example 6 | Magnetic carrier 26 | Magnetic core 1 | 0.80 | 1.20 | 4.30 | 4.50 | 0.067 | 40.9 |
| Comparative Example 7 | Magnetic carrier 27 | Magnetic core 1 | 0.80 | 1.30 | 0.00 | 0.10 | 0.072 | 45.8 |
| Comparative Example 8 | Magnetic carrier 28 | Porous magnetic core 1 | 0.80 | 1.20 | 4.20 | 4.50 | 0.091 | 43.1 |
| Comparative Example 9 | Magnetic carrier 29 | Magnetic core 1 | 0.80 | 1.20 | 4.10 | 4.20 | 0.085 | 54.3 |
| Comparative Example 10 | Magnetic carrier 30 | Magnetic core 1 | 0.70 | 1.40 | 4.30 | 4.40 | 0.065 | 47.3 |
| Comparative Example 11 | Magnetic carrier 31 | Magnetic core 1 | 0.80 | 1.30 | 4.50 | 4.50 | 0.100 | 51.5 |
| Comparative Example 12 | Magnetic carrier 32 | Magnetic core 1 | 0.80 | 1.20 | 4.10 | 4.40 | 0.088 | 40.2 |
| Comparative Example 13 | Magnetic carrier 33 | Magnetic core 1 | 0.90 | 1.00 | 4.20 | 4.90 | 0.083 | 39.5 |

<Production Example of Toner 1>

| | |
|---|---|
| Polyester resin<br>Tg: 58° C.<br>Acid value: 15 mgKOH/g<br>Hydroxyl value: 15 mgKOH/g<br>Molecular weight: Mp 5,800, Mn 3,350, Mw 94,000 | 100 parts by mass |
| C.I. Pigment Blue 15:3 | 4.5 parts by mass |
| Aluminum 1,4-di-t-butylsalicylate compound | 0.5 part by mass |
| Normal paraffin wax<br>Melting point: 78° C. | 6.0 parts by mass |

The materials according to the formulation were mixed well with a Henschel mixer (Model FM-75J, manufactured by Nippon Coke & Engineering Co., Ltd.), and were then kneaded with a biaxial kneader (Model PCM-30, manufactured by Ikegai Co., Ltd. (formerly Ikegai Steel Co., Ltd.)) set to a temperature of 130° C. at a feeding amount of 10 kg/h (the temperature of a kneaded product at the time of its ejection was about 150° C.). The resultant kneaded product was cooled and coarsely pulverized with a hammer mill. After that, the coarsely pulverized product was finely pulverized with a mechanical pulverizer (T-250: manufactured by Freund-Turbo Corporation (formerly Turbo Kogyo Co., Ltd.)) at a feeding amount of 15 kg/h. Thus, particles having a weight-average particle diameter of 5.5 μm, containing 55.6 number % of particles each having a particle diameter of 4.0 μm or less, and containing 0.8 vol % of particles each having a particle diameter of 10.0 μm or more were obtained. The symbol "Tg" refers to a glass transition temperature, the symbol "Mp" refers to a peak molecular weight, the symbol "Mn" refers to a number-average molecular weight, and the symbol "Mw" refers to a weight-average molecular weight.

The resultant particles were subjected to classification for cutting off fine powder and coarse powder with a rotary classifier (TTSP100 manufactured by Hosokawa Micron Ltd.). Cyan toner particles 1 each having a weight-average particle diameter of 6.3 μm, having a presence ratio of particles each having a particle diameter of 4.0 μm or less of 25.8 number %, and containing 2.4 vol % of particles each having a particle diameter of 10.0 μm or more were obtained.

Further, the following materials were loaded into a Henschel mixer (FM-75 type manufactured by Nippon Coke & Engineering Co., Ltd.) and mixed for 3 minutes with a circumferential velocity of rotary blades set to 35.0 (m/s), to thereby cause silica fine particles and titanium oxide fine particles to adhere to the surfaces of the cyan toner particles 1. Thus, a cyan toner 1 was obtained.

| | |
|---|---|
| Cyan toner particles 1 | 100 parts by mass |
| Silica fine particles | 3.5 parts by mass |

(Fine particles obtained by subjecting silica fine particles produced by a sol-gel method to a surface treatment with 1.5 mass % of hexamethyldisilazane, and then adjusting their particle size distribution to a desired distribution through classification)

| | |
|---|---|
| Titanium oxide fine particles | 0.5 part by mass |

(Fine particles obtained by subjecting metatitanic acid having anatase-type crystallinity to a surface treatment with an octylsilane compound)

In addition, yellow, magenta, and black toner particles 1 were obtained by using 7.0 parts by mass of C.I. Pigment Yellow 74, 6.3 parts by mass of C.I. Pigment Red 122, and 5.0 parts by mass of carbon black, respectively instead of 4.5 parts by mass of C.I. Pigment Blue 15:3 in the cyan toner particles 1.

Further, yellow, magenta, and black toners 1 were each obtained in the same manner as in the cyan toner 1 by causing the silica fine particles and the titanium oxide fine particles to adhere to surfaces.

The formulations and physical property values of the resultant toners are shown in Table 9.

The two-component developers 1 and the replenishing developers 1 were each subjected to a drying treatment at 25° C. under a reduced-pressure environment for 5 hours while being stirred.

The following evaluations were performed with the two-component developers 1 and the replenishing developers 1.

A reconstructed machine of a color multifunction machine image RUNNER ADVANCE C9075 PRO manufactured by Canon Inc. was used as an image-forming apparatus.

The two-component developers 1 were loaded into the developing devices of the respective colors of the multifunction machine. Replenishing developer containers into which the replenishing developers 1 of the respective colors had been loaded were set, and an image was formed, followed by the performance of the various evaluations.

Herein, a H/Ha environment under which the multifunction machine is left to stand refers to an environment state when an environment having a temperature of 30° C. and a humidity of 80% RH (high-temperature and high-humidity environment, hereinafter abbreviated as "H/H") under which the machine has been left to stand for 24 hours is changed to an environment having a temperature of 23° C. and a humidity of 5% RN (normal-temperature and low-humidity environment, hereinafter abbreviated as "N/L") over 24 hours.

TABLE 9

| | Toner particles (100 parts by mass) | | | | External additive | | Toner particle diameter | | |
|---|---|---|---|---|---|---|---|---|---|
| | Binder resin | Colorant | Releasing agent | Additive | Silica | Titania | Weight average particle diameter (μm) | Presence ratio of particles each having a particle diameter of 4.0 μm or less (number %) | Presence ratio of particles each having a particle diameter of 10.0 μm or more (vol %) |
| Cyan toner 1 | Polyester Resin | C.I. Pigment Blue 15:3 | Normal paraffin wax | Aluminum 3,5-di-t-butylsalicylate compound | 3.5 parts by mass | 0.5 part by mass | 6.3 | 25.8 | 2.4 |
| Yellow toner 1 | | C.I. Pigment Yellow 74 | | | | | 6.2 | 26.5 | 2.3 |
| Magenta toner 1 | | C.I. Pigment Red 122 | | | | | 6.4 | 25.8 | 2.5 |
| Black toner 1 | | Carbon black | | | | | 6.6 | 24.5 | 2.6 |

Example 1

10 Parts by mass of the cyan toner 1 was added to 90 parts by mass of the magnetic carrier 1, and the mixture was shaken with a shaker (Model YS-8D: manufactured by Yayoi Co., Ltd.) to prepare 300 g of a two-component cyan developer 1. Conditions for the shaking with the shaker were set to 200 rpm and 2 minutes. In addition, 300 g of a two-component developer 1 of each color was prepared in the same manner as in the two-component cyan developer 1 by using the toner 1 of each color.

Meanwhile, 90 parts by mass of the cyan toner 1 was added to 10 parts by mass of the magnetic carrier 1, and the contents were mixed in a normal-temperature and normal-humidity environment having a temperature of 23° C. and a humidity of 50% RH (hereinafter the phrase "normal-temperature and normal-humidity" is abbreviated as "N/N") with a V-type mixer for 5 minutes to provide a replenishing cyan developer 1. In addition, a replenishing developer 1 of each color was obtained in the same manner as in the replenishing cyan developer 1 by using the toner 1 of each color.

In an endurance test, under a printing environment having a temperature of 30° C. and a humidity of 80% RH (H/H), a FFH output chart having an image ratio of 40% was used. The term "FFH" refers to a value obtained by representing 256 gray levels in hexadecimal notation. **00*h*** refers to the first gray level (white ground portion) of the 256 gray levels, and FFH refers to the 256th gray level (solid portion) of the 256 gray levels.

The kind of an output image and the number of sheets of paper on which the image was output were changed in accordance with each evaluation item.

<Conditions>

| | |
|---|---|
| Paper: (81.4 g/m$^2$) | Laser beam printer paper CS-814 (Canon Marketing Japan Inc.) |

Image-forming speed: The multifunction machine was reconstructed so as to be capable of outputting a full-color image on 80 sheets of A4 size paper per minute. Development conditions: The multifunction machine was reconstructed so that its development contrast could be adjusted to an arbitrary value and automatic correction by its main body did not operate. The machine was reconstructed so that an alternating electric field to be superimposed in a developing bias had a frequency of 2.0 kHz, and its peak-to-peak voltage (Vpp) could be changed from 0.7 kV to 1.8 kV in increments of 0.1 kV. The machine was reconstructed so that an image-forming portion of each color could operate monochromatically without working with an image-forming portion of any other color (operate independently of an image-forming portion of any other color) to output an image.

The respective evaluation items are described below.

(1) Blank Dot

Under the H/Ba environment, a chart in which a halftone horizontal band (30H, width: 10 mm) and a solid horizontal band (FFH, width: 10 mm) are alternately arranged with respect to the conveying direction of transfer paper is output at an initial stage and immediately after continuous printing of 2,000 sheets. The image is read with a scanner and subjected to a binarization treatment. The brightness distribution (256 gray levels) of a certain line in the conveying direction of the binarized image was obtained. A tangent was drawn to the brightness of the halftone portion at that time, and the brightness region (area: the sum of brightness numbers) of the trailing end of the halftone portion deviating from the tangent until the tangent intersected the brightness of the solid portion was defined as a blank dot degree, followed by an evaluation based on the following criteria. The evaluation was performed with a cyan color alone.

A: less than 20 (extremely satisfactory)

B: 20 or more and less than 30 (satisfactory)

C: 30 or more and less than 40 (somewhat satisfactory)

D: 40 or more and less than 50 (the evaluated developer is at such a level as to be usable in the present invention)

E: 50 or more (the evaluated developer is at such a level as to be considered to be difficult to use in the present invention)

(2) Change in Gradation under H/Ha Environment

Under the H/Ha environment, an image in which the density of each pattern is set to a value described below is output on 10 sheets. The average of the densities of the patterns on the 10 images is calculated with an X-Rite color reflection densitometer (Color reflection densitometer X-Rite 404A).

Pattern 1: 0.10 or more and 0.15 or less

Pattern 2: 0.25 or more and 0.30 or less

Pattern 3: 0.45 or more and 0.50 or less

Pattern 4: 0.65 or more and 0.70 or less

Pattern 5: 0.85 or more and 0.90 or less

Pattern 6: 1.05 or more and 1.10 or less

Pattern 7: 1.25 or more and 1.30 or less

Pattern 8: 1.45 or more and 1.50 or less

Judgment criteria are as described below.

A: All pattern images satisfy the density ranges (extremely satisfactory).

B: One pattern image deviates from the density range (satisfactory).

C: Two pattern images deviate from the density ranges (somewhat satisfactory).

D: Three pattern images deviate from the density ranges (the evaluated developer is at such a level as to be usable in the present invention).

E: Four or more pattern images deviate from the density ranges (the evaluated developer is at such a level as to be considered to be difficult to use in the present invention).

(3) Tint Fluctuation of Mixed Color after Endurance

The tint fluctuation of a red color serving as a mixed color of yellow and magenta colors was evaluated.

Before an endurance test, the development contrast was adjusted so that the reflection density of a solid image of each color alone on paper became 1.5. After that, under the H/H environment, a red solid image was output immediately after continuous printing of 20,000 sheets, and the degree of a fluctuation in tint after the endurance relative to the tint before the endurance was identified.

<Method of Measuring Tint Fluctuation Degree>

The tint fluctuation degree is determined by measuring an a* and a b* with SpectroScan Transmission (manufactured by GretagMacbeth). Specifically, the measurement was performed under the following measurement conditions.

(Measurement Conditions)

Light source for observation: D50

Field of view for observation: 2°

Density: DIN NB

White reference: Pap

Filter: None

In general, the a* and the b* are values used in an L*a*b* colorimetric system serving as means useful in representing a color as a numerical value. The a* and the b* work together to represent a hue. The hue serves as a measure of a shade, such as a red, yellow, green, blue, or purple shade. Each of the a* and the b* represents the direction of a color, and the a* represents a red-green direction and the b* represents a yellow-blue direction. In the present invention, the tint fluctuation degree (AC) was defined as described below.

$$\Delta C=\{(a^* \text{ of image after endurance under } H/H \text{ environment}-a^* \text{ of initial image under } H/H \text{ environment})^2+(b^* \text{ of image after endurance under } H/H \text{ environment}-b^* \text{ of initial image under } H/H \text{ environment})^2\}^{1/2}$$

The measurement was performed at 5 arbitrary points in an image, and the average of the measured values was determined. An evaluation method is as follows: the a* and b* of a solid image output under each environment were measured, and the ΔC was determined from the equation.

A: $0 \leq \Delta C < 2.0$ (extremely satisfactory)

B: $2.0 \leq \Delta C < 3.5$ (satisfactory)

C: $3.5 \leq \Delta C < 5.0$ (somewhat satisfactory)

D: $5.0 \leq \Delta C < 6.5$ (The evaluated developer is at such a level as to be usable in the present invention.)

E: $6.56 \leq \Delta C$ (The evaluated developer is at such a level as to be considered to be difficult to use in the present invention.)

(4) Carrier Adhesion after Endurance

Under the H/H environment, an endurance image output evaluation was performed. After that, carrier adhesion was evaluated. A 00H image and an FFH image were output. The power source was turned off in the midst of tne output of the image, and then sampling was performed by causing a transparent adhesive tape to closely adhere onto the electrostatic latent image-bearing member before its cleaning. Then, the number of magnetic carrier particles adhering onto the electrostatic latent image-bearing member in a region measuring 3 cm by 3 cm was counted, followed by the calculation of the number of adhering carrier particles per $cm^2$. The calculated value was evaluated by the following criteria. The evaluation was performed with a cyan color alone.

A: The number is 2 or less (extremely satisfactory).

B: The number is 3 or more and 4 or less (satisfactory).

C: The number is 5 or more and 6 or less (somewhat satisfactory).

D: The number is 7 or more and 8 or less (the evaluated developer is at such a level as to be usable in the present invention).

E: The number is 9 or more (the evaluated developer is at such a level as to be considered to be difficult to use in the present invention).

(5) Image Coarseness Resistance of Halftone Image after Endurance

Under the H/H environment, an initial image output evaluation and an endurance image output evaluation (50,000 sheets) were performed. After that, a halftone image (30H) was printed on one sheet of A4 paper. The areas of 1,000 dots in an image were measured with a digital microscope VHX-500 (lens: Wide-range Zoom Lens VH-Z100 manufactured by Keyence Corporation). The number average (3) of the dot areas and the standard deviation (a) of the dot areas were calculated, and a dot reproducibility index was calculated from the following equation. Then, the image coarseness of the halftone image was defined as a dot reproducibility index (I), and its difference from an initial dot reproducibility index was determined.

$$\text{Dot reproducibility index } (I)=\sigma/S\times 100$$

With regard to criteria for the evaluation of the image coarseness, the evaluation was performed with a cyan color alone by the following criteria.

A: The difference from the initial dot reproducibility index is less than 3.0 (extremely satisfactory).

B: The difference from the initial dot reproducibility index is 3.0 or more and less than 5.0 (satisfactory).

C: The difference from the initial dot reproducibility index is 5.0 or more and less than 8.0 (somewhat satisfactory).

D: The difference from the initial dot reproducibility index is 8.0 or more and less than 10.0 (the evaluated developer is at such a level as to be usable in the present invention).

E: The difference from the initial dot reproducibility index is 10.0 or more (the evaluated developer is at such a level as to be considered to be difficult to use in the present invention).

(6) Developability after Endurance

The evaluation of developability after endurance was performed as described below. Under the H/H environment, an initial Vpp was fixed to 1.3 kV, and the contrast potential at which the density of a solid image formed only of a cyan color became 1.50 (reflection density) was set.

After 20,000-sheet endurance in the setting, while the Vpp was maintained at 1.3 kV, the contrast potential at which the image density became 1.50 was determined and its difference from the initial potential was determined. The evaluation was performed with a cyan color alone.

The reflection density was measured with a spectral densitometer 500 Series (manufactured by X-Rite).

<Criteria for Evaluation of Developability>

A: The difference from the initial potential is less than 40 V (extremely satisfactory).

B: The difference from the initial potential is 40 V or more and less than 60 V (satisfactory).

C: The difference from the initial potential is 60 V or more and less than 80 V (somewhat satisfactory).

D: The difference from the initial potential is 80 V or more and less than 100 V (the evaluated developer is at such a level as to be usable in the present invention).

E: The difference from the initial potential is 100 V or more (the evaluated developer is at such a level as to be considered to be difficult to use in the present invention).

(7) Change in Gradation after Endurance Relative to Gradation Before Endurance

An image in which the density of each pattern was set to a value described below in initial setting was output immediately after the printing of 2,000 sheets under the H/H environment, and a deviation between gradation at an initial stage and that immediately after the printing of the 2,000 sheets was identified. The image was judged by measuring the image density of each pattern with an X-Rite color reflection densitometer (Color reflection densitometer X-Rite 404A). The evaluation was performed with a cyan color alone.

Pattern 1: 0.10 or more and 0.13 or less
Pattern 2: 0.25 or more and 0.28 or less
Pattern 3: 0.45 or more and 0.48 or less
Pattern 4: 0.65 or more and 0.68 or less
Pattern 5: 0.85 or more and 0.88 or less
Pattern 6: 1.05 or more and 1.08 or less
Pattern 7: 1.25 or more and 1.28 or less
Pattern 8: 1.45 or more and 1.48 or less Judgment criteria are as described below.

A: All pattern images satisfy the density ranges (extremely satisfactory).

B: One pattern image deviates from the density range (satisfactory).

C: Two pattern images deviate from the density ranges (somewhat satisfactory).

D: Three pattern images deviate from the density ranges (the evaluated developer is at such a level as to be usable in the present invention).

E: Four or more pattern images deviate from the density ranges (the evaluated developer is at such a level as to be considered to be difficult to use in the present invention).

(8) Comprehensive Judgment

Evaluation ranks in the evaluation items (1) to (7) were turned into numerical values, and judgement was performed with their total value by the following criteria. With regard to the evaluation item (1), comprehensive judgment is performed with an evaluation rank after endurance. In addition, the evaluation ranks of the items except the evaluation item (6) are turned into numerical values as follows: "A=5, B=4, C=3, D=2, and E=0." The evaluation ranks of the evaluation item (6) are turned into numerical values as follows: "A=10, B=8, C=6, D=4, and E=2."

A: 35 or more: extremely satisfactory

B: 28 or more and 34 or less: satisfactory

C: 20 or more and 27 or less: somewhat satisfactory

D: 15 or more and 19 or less: the evaluated developer is at such a level as to be usable in the present invention.

E: 14 or less: the evaluated developer is at such a level as to be considered to be difficult to use in the present invention.

In Example 1, an extremely satisfactory result was obtained in each of the evaluations. The results of the evaluations are shown in Table 10-1 to Table 10-3.

Examples 2 and 4

Two-component developers 2 and 4, and replenishing developers 2 and 4 were prepared in the same manner as in Example 1 by using the magnetic carriers 2 and 4 at the same ratios as those of Example 1. Evaluations were performed in the same manner as in Example 1 except that the resultant two-component developers 2 and 4, and the resultant replenishing developers 2 and 4 were used.

Examples 2 and 4 differed from Example 1 in additive particle species and in method for the treatment of hydroxyl groups on the surfaces of additive particles, but in each of the examples, the moisture percentage change was small and hence extremely satisfactory results were obtained. The results of the evaluations are shown in Table 10-1 to Table 10-3.

Example 3

A two-component developer 3 and a replenishing developer 3 were prepared in the same manner as in Example 1 by using the magnetic carrier 3 at the same ratios as those of Example 1. Evaluations were performed in the same manner as in Example 1 except that the resultant two-component developer 3 and the resultant replenishing developer 3 were used.

Example 3 differed from Example 1 in additive particle species and in method for the treatment of hydroxyl groups on the surfaces of additive particles, and hence influences on the charging characteristics occurred and a satisfactory result was obtained for the developability. In addition, extremely satisfactory results were obtained for the items except the foregoing. The results of the evaluations are shown in Table 10-1 to Table 10-3.

Example 5

A two-component developer 5 and a replenishing developer 5 were prepared in the same manner as in Example 1 by using the magnetic carrier 5 at the same ratios as those of Example 1. Evaluations were performed in the same manner as in Example 1 except that the resultant two-component developer 5 and the resultant replenishing developer 5 were used.

Example 5 differed from Example 1 in additive particle species and in method for the treatment of hydroxyl groups on the surfaces of additive particles, and hence influences on the charging characteristics occurred to slightly reduce the developability, and a satisfactory result was obtained. In addition, extremely satisfactory results were obtained for the items except the foregoing. The results of the evaluations are shown in Table 10-1 to Table 10-3.

Examples 6 and 8

Two-component developers 6 and 8, and replenishing developers 6 and 8 were prepared in the same manner as in Example 1 by using the magnetic carriers 6 and 8 at the same ratios as those of Example 1. Evaluations were performed in the same manner as in Example 1 except that the resultant two-component developers 6 and 6, and the resultant replenishing developers 6 and 8 were used.

Examples 6 and 8 differed from Example 1 in method for the treatment of hydroxyl groups on the surfaces of additive particles, but in each of the examples, the moisture percentage change was small and hence extremely satisfactory results were obtained. The results of the evaluations are shown in Table 10-1 to Table 10-3.

Example 7

A two-component developer 7 and a replenishing developer 7 were prepared in the same manner as in Example 1 by using the magnetic carrier 7 at the same ratios as those of Example 1. Evaluations were performed in the same manner as in Example 1 except that the resultant two-component developer 7 and the resultant replenishing developer 7 were used.

Example 7 differed from Example 1 in method for the treatment of hydroxyl groups on the surfaces of additive particles, and hence influences on the charging characteristics occurred and a satisfactory result was obtained for the developability. In addition, extremely satisfactory results were obtained for the items except the foregoing. The results of the evaluations are shown in Table 10-1 to Table 10-3.

Examples 9 and 10

Two-component developers 9 and 10, and replenishing developers 9 and 10 were prepared in the same manner as in Example 1 by using the magnetic carriers 9 and 10 at the same ratios as those of Example 1. Evaluations were performed in the same manner as in Example 1 except that the resultant two-component developers 9 and 10, and the resultant replenishing developers 9 and 10 were used.

Examples 9 and 10 differ from Example 1 in additive particle species. In addition, Examples 9 and 10 differ from Example 1 in method for the treatment of hydroxyl groups on the surfaces of additive particles. Accordingly, influences on the tint and the developability after the endurance occurred, but satisfactory results were obtained for both the items. In addition, extremely satisfactory results were obtained for the items except the foregoing. The results of the evaluations are shown in Table 10-1 to Table 10-3.

Examples 11 and 12

Two-component developers 11 and 12, and replenishing developers 11 and 12 were prepared in the same manner as in Example 1 by using the magnetic carriers 11 and 12 at the same ratios as those of Example 1. Evaluations were performed in the same manner as in Example 1 except that the resultant two-component developers 11 and 12, and the resultant replenishing developers 11 and 12 were used.

Examples 11 and 12 differ from Example 1 in additive particle species. In addition, Examples 11 and 12 differ from Example 1 in method for the treatment of hydroxyl groups on the surfaces of additive particles. Accordingly, influences on the tint and the developability after the endurance occurred, but satisfactory results were obtained for both the items. In addition, extremely satisfactory results were obtained for the items except the foregoing. The results of the evaluations are shown in Table 10-1 to Table 10-3.

Example 13

A two-component developer 13 and a replenishing developer 13 were prepared in the same manner as in Example 1 by using the magnetic carrier 13 at the same ratios as those of Example 1. Evaluations were performed in the same manner as in Example 1 except that the resultant two-component developer 13 and the resultant replenishing developer 13 were used.

Example 13 differs from Example 1 in additive particle species. In addition, Example 13 differs from Example 1 in method for the treatment of hydroxyl groups on the surfaces of additive particles. Accordingly, influences on the tint and the developability after the endurance occurred, but satisfactory results were obtained for both the items. In addition, the bulk core having a high true density was used as a magnetic core, and hence influences on the charging characteristics occurred, and the results of the evaluations of the blank dot, the carrier adhesion after the endurance, the image coarseness resistance of the halftone image after the endurance, and the change in gradation after the endurance relative to the gradation before the endurance slightly deteriorated. However, satisfactory results were obtained for all of those items. In addition, extremely satisfactory results were obtained for the items except the foregoing. The results of the evaluations are shown in Table 10-1 to Table 10-3.

Example 14

A two-component developer 14 and a replenishing developer 14 were prepared in the same manner as in Example 1 by using the magnetic carrier 14 at the same ratios as those of Example 1. Evaluations were performed in the same manner as in Example 1 except that the resultant two-component developer 14 and the resultant replenishing developer 14 were used.

Example 14 differs from Example 1 in that the chemical modification of hydroxy groups with the esterifying agent is performed as a method for the treatment of additive particle species. Accordingly, influences on the blank dot, the fluctuation in gradation, the carrier adhesion after the endurance, the developability after the endurance, and the change in gradation after the endurance relative to the gradation before the endurance occurred, but satisfactory results were obtained for all of these items. In addition, a somewhat satisfactory result was obtained for the image coarseness resistance of the halftone image after the endurance. The results of the evaluations are shown in Table 10-1 to Table 10-3.

Example 15

A two-component developer 15 and a replenishing developer 15 were prepared in the same manner as in Example 1 by using the magnetic carrier 15 at the same ratios as those of Example 1. Evaluations were performed in the same manner as in Example 1 except that the resultant two-component developer 15 and the resultant replenishing developer 15 were used.

Example 15 differs from Example 1 in that no treatment is performed on the additive particle species. As a result, influences on the blank dot, the fluctuation in gradation, and the tint fluctuation of the mixed color occurred, but satisfactory results were obtained for all of these items. In addition, the results of the evaluations of the carrier adhesion after the endurance, the image coarseness resistance of the halftone image after the endurance, the developability after the endurance, and the change in gradation after the endurance relative to the gradation before the endurance deteriorated, but somewhat satisfactory results were obtained for all of these items. The results of the evaluations are shown in Table 10-1 to Table 10-3.

Example 16

A two-component developer 16 and a replenishing developer 16 were prepared in the same manner as in Example 1 by using the magnetic carrier 16 at the same ratios as those of Example 1. Evaluations were performed in the same manner as in Example 1 except that the resultant two-component developer 16 and the resultant replenishing developer 16 were used.

Example 16 differs from Example 1 in that the chemical modification of hydroxy groups with the esterifying agent is performed as a method for the treatment of additive particle species. Example 16 also differs from Example 1 in that the bulk core having a high true density is used as a magnetic core, and in that the same resin is used in the surface resin layer and intermediate resin layer of the coating resin. As a result, influences on the blank dot, the fluctuation in gradation, and the tint fluctuation of the mixed color occurred, but somewhat satisfactory results were obtained for all of these items. In addition, the results of the evaluations of the carrier adhesion after the endurance, the image coarseness resistance of the halftone image after the endurance, the developability after the endurance, and the change in gradation after the endurance relative to the gradation before the endurance deteriorated, and hence the evaluated developer was at such a level as to be usable in the present invention in terms of all of these items. The results of the evaluations are shown in Table 10-1 to Table 10-3.

Example 17

A two-component developer 17 and a replenishing developer 17 were prepared in the same manner as in Example 1 by using the magnetic carrier 17 at the same ratios as those of Example 1. Evaluations were performed in the same manner as in Example 1 except that the resultant two-component developer 17 and the resultant replenishing developer 17 were used.

Example 17 differs from Example 1 in that the chemical modification of hydroxy groups with the esterifying agent is performed as a method for the treatment of additive particle species. Example 17 also differs from Example 1 in that the bulk core having a high true density is used as a magnetic core, and in that the same resin is used in the surface resin layer and intermediate resin layer of the coating resin. Example 17 also differs from Example 1 in thickness of the surface resin layer. As a result, influences on the blank dot, and the fluctuation in gradation occurred, but somewhat satisfactory results were obtained for all of these items. In addition, the results of the evaluations of the tint fluctuation of the mixed color, the carrier adhesion after the endurance, the image coarseness resistance of the halftone image after the endurance, the developability after the endurance, and the change in gradation after the endurance relative to the gradation before the endurance deteriorated, and hence the evaluated developer was at such a level as to be usable in the present invention in terms of all of these items. The results of the evaluations are shown in Table 10-1 to Table 10-3.

Example 18

A two-component developer 18 and a replenishing developer 18 were prepared in the same manner as in Example 1 by using the magnetic carrier 18 at the same ratios as those of Example 1. Evaluations were performed in the same manner as in Example 1 except that the resultant two-component developer 18 and the resultant replenishing developer 18 were used.

Example 18 differs from Example 1 in that the chemical modification of hydroxy groups with the esterifying agent is performed as a method for the treatment of additive particle species. Example 18 also differs from Example 1 in that the bulk core having a high true density is used as a magnetic core, and in that the same resin is used in the surface resin layer and intermediate resin layer of the coating resin. Example 18 also differs from Example 1 in thickness of the surface resin layer. As a result, influences on the blank dot, and the fluctuation in gradation occurred, but somewhat satisfactory results were obtained for all of these items. In addition, the results of the evaluations of the tint fluctuation of the mixed color, the carrier adhesion after the endurance, the image coarseness resistance of the halftone image after the endurance, the developability after the endurance, and the change in gradation after the endurance relative to the gradation before the endurance deteriorated, and hence the evaluated developer was at such a level as to be usable in the present invention in terms of all of these items. The results of the evaluations are shown in Table 10-1 to Table 10-3.

Example 19

A two-component developer 19 and a replenishing developer 19 were prepared in the same manner as in Example 1 by using the magnetic carrier 19 at the same ratios as those of Example 1. Evaluations were performed in the same manner as in Example 1 except that the resultant two-component developer 19 and the resultant replenishing developer 19 were used.

Example 19 differs from Example 1 in that the chemical modification of hydroxy groups with the esterifying agent is performed as a method for the treatment of additive particle species. Example 19 also differs from Example 1 in that the bulk core having a high true density is used as a magnetic core, and in that the same resin is used in the surface resin layer and intermediate resin layer of the coating resin. Example 19 also differs from Example 1 in thickness of the surface resin layer. As a result, influences on the blank dot occurred, but somewhat satisfactory results were obtained. In addition, the results of the evaluations of the fluctuation in gradation, the tint fluctuation of the mixed color, the carrier adhesion after the endurance, the image coarseness resistance of the halftone image after the endurance, the developability after the endurance, and the change in gradation after the endurance relative to the gradation before the endurance deteriorated, and hence the evaluated developer was at such a level as to be usable in the present invention in terms of all of these items. The results of the evaluations are shown in Table 10-1 to Table 10-3.

Example 20

A two-component developer 20 and a replenishing developer 20 were prepared in the same manner as in Example 1 by using the magnetic carrier 20 at the same ratios as those of Example 1. Evaluations were performed in the same manner as in Example 1 except that the resultant two-component developer 20 and the resultant replenishing developer 20 were used.

Example 20 differs from Example 1 in that the chemical modification of hydroxy groups with the esterifying agent is performed as a method for the treatment of additive particle species. Example 20 also differs from Example 1 in that the bulk core having a high true density is used as a magnetic core, and in that the same resin is used in the surface resin layer and intermediate resin layer of the coating resin. Example 20 also differs from Example 1 in thickness of the surface resin layer. As a result, influences on the blank dot occurred, but somewhat satisfactory results were obtained. In addition, the results of the evaluations of the fluctuation in gradation, the tint fluctuation of the mixed color, the carrier adhesion after the endurance, the image coarseness resistance of the halftone image after the endurance, the developability after the endurance, and the change in gradation after the endurance relative to the gradation before the endurance deteriorated, and hence the evaluated developer was at such a level as to be usable in the present invention in terms of all of these items. The results of the evaluations are shown in Table 10-1 to Table 10-3.

Comparative Example 1

A two-component developer 21 and a replenishing developer 21 were prepared in the same manner as in Example 1 by using the magnetic carrier 21 at the same ratios as those of Example 1. Evaluations were performed in the same manner as in Example 1 except that the resultant two-component developer 21 and the resultant replenishing developer 21 were used.

Comparative Example 1 differs from Example 19 in that the solid content coating amount is changed in the intermediate resin layer formation step. As a result, influences on the blank dot, the fluctuation in gradation, and the tint fluctuation of the mixed color occurred, and hence the evaluated developer was at such a level as to be hardly put into practical use in the present invention in terms of all of these items. In addition, the evaluated developer was at such a level as to be usable in the present invention in terms of all the items except the foregoing. The results of the evaluations are shown in Table 10-1 to Table 10-3.

Comparative Example 2

A two-component developer 22 and a replenishing developer 22 were prepared in the same manner as in Example 1 by using the magnetic carrier 22 at the same ratios as those of Example 1. Evaluations were performed in the same manner as in Example 1 except that the resultant two-component developer 22 and the resultant replenishing developer 22 were used.

Comparative Example 2 differs from Example 19 in that the organic fine particles are used as additive particles. As a result, influences on the blank dot, the fluctuation in gradation, the tint fluctuation of the mixed color, and the change in gradation after the endurance relative to the gradation before the endurance occurred, and hence the evaluated developer was at such a level as to be hardly put into practical use in the present invention in terms of all of these items. In addition, the evaluated developer was at such a level as to be usable in the present invention in terms of all the items except the foregoing. The results of the evaluations are shown in Table 10-1 to Table 10-3.

Comparative Example 3

A two-component developer 23 and a replenishing developer 23 were prepared in the same manner as in Example 1 by using the magnetic carrier 23 at the same ratios as those of Example 1. Evaluations were performed in the same manner as in Example 1 except that the resultant two-component developer 23 and the resultant replenishing developer 23 were used.

Comparative Example 3 differs from Example 19 in kind of an esterification treatment agent for additive particles, and lipophilic functional groups are introduced into the surfaces of the particles. As a result, influences on the blank dot, the fluctuation in gradation, the tint fluctuation of the mixed color, and the change in gradation after the endurance relative to the gradation before the endurance occurred, and hence the evaluated developer was at such a level as to be hardly put into practical use in the present invention in terms of all of these items. In addition, the evaluated developer was at such a level as to be usable in the present invention in terms of all the items except the foregoing. The results of the evaluations are shown in Table 10-1 to Table 10-3.

Comparative Example 4

A two-component developer 24 and a replenishing developer 24 were prepared in the same manner as in Example 1 by using the magnetic carrier 24 at the same ratios as those of Example 1. Evaluations were performed in the same manner as in Example 1 except that the resultant two-component developer 24 and the resultant replenishing developer 24 were used.

Comparative Example 4 differs from Example 19 in that the additive particle species are treated with lauric acid. As a result, influences on the blank dot, the fluctuation in gradation, the tint fluctuation of the mixed color, the carrier adhesion after the endurance, and the change in gradation after the endurance relative to the gradation before the endurance occurred, and hence the evaluated developer was at such a level as to be hardly put into practical use in the present invention in terms of all of these items. In addition, the evaluated developer was at such a level as to be usable in the present invention in terms of all the items except the foregoing. The results of the evaluations are shown in Table 10-1 to Table 10-3.

Comparative Example 5

A two-component developer 25 and a replenishing developer 25 were prepared in the same manner as in Example 1 by using the magnetic carrier 25 at the same ratios as those of Example 1. Evaluations were performed in the same manner as in Example 1 except that the resultant two-component developer 25 and the resultant replenishing developer 25 were used.

Comparative Example 5 differs from Example 19 in kind of an esterification treatment agent for additive particles, and lipophilic functional groups are introduced into the surfaces of the particles. As a result, influences on the blank dot, the fluctuation in gradation, the tint fluctuation of the mixed color, the carrier adhesion after the endurance, and the change in gradation after the endurance relative to the gradation before the endurance occurred, and hence the evaluated developer was at such a level as to be hardly put into practical use in the present invention in terms of all of these items. In addition, the evaluated developer was at such a level as to be usable in the present invention in terms of all the items except the foregoing. The results of the evaluations are shown in Table 10-1 to Table 10-3.

Comparative Example 6

A two-component developer 26 and a replenishing developer 26 were prepared in the same manner as in Example 1 by using the magnetic carrier 26 at the same ratios as those of Example 1. Evaluations were performed in the same manner as in Example 1 except that the resultant two-component developer 26 and the resultant replenishing developer 26 were used.

Comparative Example 6 differs from Example 19 in kind of an esterification treatment agent for additive particles, and lipophilic functional groups are Introduced into the surfaces of the particles. As a result, influences on the blank dot, the fluctuation in gradation, the tint fluctuation of the mixed color, the carrier adhesion after the endurance, the developability after the endurance, and the change in gradation after the endurance relative to the gradation before the endurance occurred, and hence the evaluated developer was at such a level as to be hardly put into practical use in the present invention in terms of all of these items. In addition, the evaluated developer was at such a level as to be usable in the present invention in terms of the image coarseness resistance of the halftone image after the endurance. The results of the evaluations are shown in Table 10-1 to Table 10-3.

Comparative Example 7

A two-component developer 27 and a replenishing developer 27 were prepared in the same manner as in Example 1 by using the magnetic carrier 27 at the same ratios as those of Example 1. Evaluations were performed in the same manner as in Example 1 except that the resultant two-component developer 27 and the resultant replenishing developer 27 were used.

Comparative Example 7 differs from Example 19 in kind of an esterification treatment agent for additive particles, and lipophilic functional groups are introduced into the surfaces of the particles. As a result, influences on the blank dot, the fluctuation in gradation, the tint fluctuation of the mixed color, the carrier adhesion after the endurance, the developability after the endurance, and the change in gradation after the endurance relative to the gradation before the endurance occurred, and hence the evaluated developer was at such a level as to be hardly put into practical use in the present invention in terms of all of these items. In addition, the evaluated developer was at such a level as to be usable in the present invention in terms of the image coarseness resistance of the halftone image after the endurance. The results of the evaluations are shown in Table 10-1 to Table 10-3.

Comparative Examples 8 and 9

Two-component developers 28 and 29, and replenishing developers 28 and 29 were prepared in the same manner as in Example 1 by using the magnetic carriers 28 and 29 at the same ratios as those of Example 1. Evaluations were performed in the same manner as in Example 1 except that the resultant two-component developers 28 and 29, and the resultant replenishing developers 28 and 29 were used.

Comparative Examples 8 and 9 differ from Example 19 in kind of an esterification treatment agent for additive particles, and lipophilic functional groups are introduced into the surfaces of the particles. As a result, influences on all the evaluations occurred, and hence the evaluated developers were each at such a level as to be hardly put into practical use in the present invention in terms of all the items. The results of the evaluations are shown in Table 10-1 to Table 10-3.

Comparative Example 10

A two-component developer 30 and a replenishing developer 30 were prepared in the same manner as in Example 1 by using the magnetic carrier 30 at the same ratios as those of Example 1. Evaluations were performed in the same manner as in Example 1 except that the resultant two-component developer 30 and the resultant replenishing developer 30 were used.

Comparative Example 10 differs from Example 19 in kind of an esterification treatment agent for additive particles, and lipophilic functional groups are introduced into the surfaces of the particles. As a result, influences on all the evaluations occurred, and hence the evaluated developers were each at such a level as to be hardly put into practical use in the present invention in terms of all the items. The results of the evaluations are shown in Table 10-1 to Table 10-3.

Comparative Example 11

A two-component developer 31 and a replenishing developer 31 were prepared in the same manner as in Example 1 by using the magnetic carrier 31 at the same ratios as those of Example 1. Evaluations were performed in the same manner as in Example 1 except that the resultant two-component developer 31 and the resultant replenishing developer 31 were used.

Comparative Example 11 differs from Example 19 in kind of an esterification treatment agent for additive particles, and lipophilic functional groups are introduced into the surfaces of the particles. As a result, influences on all the evaluations occurred, and hence the evaluated developer was at such a level as to be hardly put into practical use in the present invention in terms of all the items. The results of the evaluations are shown in Table 10-1 to Table 10-3.

Comparative Example 12

A two-component developer 32 and a replenishing developer 32 were prepared in the same manner as in Example 1 by using the magnetic carrier 32 at the same ratios as those of Example 1. Evaluations were performed in the same manner as in Example 1 except that the resultant two-component developer 32 and the resultant replenishing developer 32 were used.

Comparative Example 12 differs from Example 19 in kind of an esterification treatment agent for additive particles, and lipophilic functional groups are introduced into the surfaces of the particles. As a result, influences on all the evaluations occurred, and hence the evaluated developer was at such a level as to be hardly put into practical use in the present invention in terms of all the items. The results of the evaluations are shown in Table 10-1 to Table 10-3.

Comparative Example 13

A two-component developer 33 and a replenishing developer 33 were prepared in the same manner as in Example 1 by using the magnetic carrier 33 at the same ratios as those of Example 1. Evaluations were performed in the same manner as in Example 1 except that the resultant two-component developer 33 and the resultant replenishing developer 33 were used.

Comparative Example 13 differs from Example 19 in kind of an esterification treatment agent for additive particles, and lipophilic functional groups are introduced into the surfaces of the particles. As a result, influences on all the evaluations occurred, and hence the evaluated developer was at such a level as to be hardly put into practical use in the present invention in terms of all the items. The results of the evaluations are shown in Table 10-1 to Table 10-3.

TABLE 10-1

| | Blank dot | | | | Fluctuation in gradation density under H/Ha environment | | |
|---|---|---|---|---|---|---|---|
| | Initial stage (sum of brightness numbers) | Evaluation | After endurance (sum of brightness numbers) | Evaluation | Deviating pattern number | Number of deviating patterns (patterns) | Evaluation |
| Example 1 | 11.00 | A | 16.00 | A | — | 0 | A |
| Example 2 | 13.00 | A | 16.00 | B | — | 0 | A |
| Example 3 | 15.00 | A | 16.00 | A | — | 0 | A |
| Example 4 | 12.00 | A | 17.00 | A | — | 0 | A |
| Example 5 | 14.00 | A | 16.00 | A | — | 0 | A |
| Example 6 | 17.00 | A | 18.00 | A | — | 0 | A |
| Example 7 | 15.00 | A | 18.00 | A | — | 0 | A |
| Example 8 | 11.00 | A | 16.00 | A | — | 0 | A |
| Example 9 | 13.00 | A | 16.00 | A | — | 0 | A |
| Example 10 | 15.00 | A | 16.00 | A | — | 0 | A |
| Example 11 | 12.00 | A | 17.00 | A | — | 0 | A |
| Example 12 | 14.00 | A | 16.00 | A | — | 0 | A |
| Example 13 | 11.00 | A | 25.00 | B | — | 0 | A |
| Example 14 | 13.00 | A | 26.00 | B | 2 | 1 | B |
| Example 15 | 15.00 | A | 29.00 | B | 5 | 1 | B |
| Example 16 | 12.00 | A | 33.00 | C | 4, 2 | 2 | C |
| Example 17 | 14.00 | A | 36.00 | C | 5, 7 | 2 | C |
| Example 18 | 17.00 | A | 37.00 | C | 3, 4 | 2 | C |
| Example 19 | 15.00 | A | 36.00 | C | 4, 5, 6 | 3 | D |
| Example 20 | 11.00 | A | 35.00 | C | 6, 7, 8 | 3 | D |
| Comparative Example 1 | 13.00 | A | 57.00 | E | 2, 5, 6, 7 | 4 | E |
| Comparative Example 2 | 15.00 | A | 59.00 | E | 2, 3, 4, 7, 8 | 5 | E |
| Comparative Example 3 | 12.00 | A | 61.00 | E | 2, 3, 5, 7 | 4 | E |
| Comparative Example 4 | 14.00 | A | 57.00 | E | 1, 4, 5, 6, 7, 9 | 6 | E |
| Comparative Example 5 | 11.00 | A | 59.00 | E | 1, 2, 3, 4, 5, 6, 7 | 7 | E |
| Comparative Example 6 | 13.00 | A | 61.00 | E | 2, 3, 4, 5, 6 | 5 | E |
| Comparative Example 7 | 15.00 | A | 57.00 | E | 1, 3, 5, 7 | 4 | E |
| Comparative Example 8 | 12.00 | A | 59.00 | E | 2, 4, 6, 7, 8 | 5 | E |
| Comparative Example 9 | 14.00 | A | 61.00 | E | 2, 3, 5, 6, 7, 8 | 6 | E |
| Comparative | 17.00 | A | 57.00 | E | 2, 3, 4, 5, 6, | 7 | E |

TABLE 10-1-continued

| | Blank dot | | | | Fluctuation in gradation density under H/Ha environment | | |
|---|---|---|---|---|---|---|---|
| | Initial stage (sum of brightness numbers) | Evaluation | After endurance (sum of brightness numbers) | Evaluation | Deviating pattern number | Number of deviating patterns (patterns) | Evaluation |
| Example 10 | | | | | 7, 8 | | |
| Comparative Example 11 | 15.00 | A | 60.00 | E | 1, 2, 3, 4, 5, 6, 7, 8 | 8 | E |
| Comparative Example 12 | 11.00 | A | 61.00 | E | 1, 2, 3, 5, 6, 8 | 8 | E |
| Comparative Example 13 | 13.00 | A | 57.00 | E | 1, 3, 5, 8 | 4 | E |

TABLE 10-2

| | Red hue (a* b*) | | | | | | Carrier adhesion after endurance | |
|---|---|---|---|---|---|---|---|---|
| | Initial stage under HH | | After endurance under HH | | Degree of fluctuation | | Number of carrier particles | |
| | a* | b* | a* | b* | ΔC | Evaluation | (particles) | Evaluation |
| Example 1 | 44.98 | 37.46 | 44.25 | 36.31 | 1.36 | A | 0 | A |
| Example 2 | 44.67 | 36.57 | 43.05 | 35.85 | 1.77 | A | 1 | A |
| Example 3 | 44.67 | 36.57 | 43.05 | 35.85 | 1.77 | A | 2 | A |
| Example 4 | 44.85 | 36.83 | 43.59 | 35.41 | 1.90 | A | 0 | A |
| Example 5 | 43.05 | 36.41 | 43.21 | 35.25 | 1.17 | A | 1 | A |
| Example 6 | 44.79 | 37.40 | 44.50 | 35.44 | 1.98 | A | 2 | A |
| Example 7 | 43.58 | 38.03 | 42.22 | 37.15 | 1.62 | A | 1 | A |
| Example 8 | 44.55 | 36.95 | 42.81 | 36.44 | 1.61 | B | 2 | A |
| Example 9 | 43.21 | 38.04 | 41.46 | 35.44 | 3.13 | B | 1 | A |
| Example 10 | 45.21 | 38.93 | 43.69 | 36.44 | 2.92 | B | 0 | A |
| Example 11 | 46.35 | 38.47 | 43.57 | 37.36 | 2.99 | B | 1 | A |
| Example 12 | 47.22 | 38.54 | 44.52 | 36.51 | 3.38 | B | 1 | A |
| Example 13 | 46.11 | 36.95 | 43.49 | 36.55 | 2.66 | B | 3 | B |
| Example 14 | 43.44 | 37.33 | 45.21 | 34.80 | 3.09 | B | 3 | B |
| Example 15 | 45.21 | 38.93 | 43.69 | 36.44 | 2.92 | B | 5 | C |
| Example 16 | 45.46 | 39.01 | 43.74 | 34.50 | 4.83 | C | 7 | D |
| Example 17 | 47.40 | 38.90 | 43.48 | 33.41 | 5.96 | D | 7.5 | D |
| Example 18 | 47.20 | 39.50 | 43.20 | 35.60 | 5.59 | D | 8 | D |
| Example 19 | 47.75 | 38.74 | 43.91 | 34.18 | 5.96 | D | 7 | D |
| Example 20 | 47.75 | 37.84 | 43.91 | 34.18 | 5.30 | D | 7 | D |
| Comparative Example 1 | 44.88 | 36.57 | 39.57 | 32.10 | 6.94 | E | 7 | D |
| Comparative Example 2 | 46.12 | 35.44 | 39.57 | 36.74 | 6.68 | E | 7 | D |
| Comparative Example 3 | 44.75 | 36.82 | 38.57 | 33.78 | 6.89 | E | 7 | D |
| Comparative Example 4 | 47.75 | 36.74 | 42.12 | 34.18 | 7.25 | E | 9 | E |
| Comparative Example 5 | 45.25 | 37.03 | 40.19 | 32.78 | 6.61 | E | 10 | E |
| Comparative Example 6 | 46.40 | 38.00 | 42.51 | 31.50 | 7.58 | E | 12 | E |
| Comparative Example 7 | 44.67 | 39.10 | 41.70 | 32.10 | 7.60 | E | 9 | E |
| Comparative Example 8 | 45.33 | 37.36 | 39.80 | 32.45 | 7.40 | E | 11 | E |
| Comparative Example 9 | 44.75 | 36.82 | 38.57 | 33.78 | 6.89 | E | 10 | E |
| Comparative Example 10 | 47.75 | 38.74 | 43.91 | 31.24 | 8.43 | E | 12 | E |
| Comparative Example 11 | 45.25 | 37.09 | 40.19 | 32.78 | 6.61 | E | 11 | E |
| Comparative Example 12 | 46.40 | 36.85 | 41.16 | 32.90 | 6.57 | E | 13 | E |
| Comparative Example 13 | 46.40 | 37.50 | 43.22 | 31.50 | 6.79 | E | 10 | E |

TABLE 10-3

| | Image coarseness resistance | | Developability after endurance | | Fluctuation in gradation density after endurance | | | Comprehensive evaluation | |
|---|---|---|---|---|---|---|---|---|---|
| | Difference from initial value (I) | Evaluation | Difference from initial value (V) | Evaluation | Deviating pattern number | Number of deviating patterns (patterns) | Evaluation | Judgment index | Evaluation |
| Example 1 | 2.9 | A | 34 | A | — | 0 | A | 40 | A |
| Example 2 | 1.5 | A | 28 | A | — | 0 | A | 40 | A |
| Example 3 | 1.4 | A | 43 | B | — | 0 | A | 38 | A |
| Example 4 | 1.3 | A | 21 | A | — | 0 | A | 40 | A |
| Example 5 | 1.0 | A | 55 | B | — | 0 | A | 38 | A |
| Example 6 | 2.0 | A | 30 | A | — | 0 | A | 40 | A |
| Example 7 | 2.1 | A | 45 | B | — | 0 | A | 38 | A |
| Example 8 | 2.5 | A | 29 | A | — | 0 | A | 40 | A |
| Example 9 | 1.9 | A | 42 | B | — | 0 | A | 37 | A |
| Example 10 | 2.4 | A | 43 | B | — | 0 | A | 37 | A |
| Example 11 | 1.2 | A | 49 | B | — | 0 | A | 37 | A |
| Example 12 | 1.4 | A | 51 | B | — | 0 | A | 37 | A |
| Example 13 | 3.6 | B | 51 | B | 2 | 1 | B | 33 | B |
| Example 14 | 6.4 | C | 45 | B | 3 | 1 | B | 31 | B |
| Example 15 | 6.9 | C | 65 | C | 5, 6 | 2 | C | 27 | C |
| Example 16 | 8.5 | D | 85 | D | 4, 5, 6 | 3 | D | 19 | D |
| Example 17 | 8.9 | D | 89 | D | 2, 4, 7 | 3 | D | 18 | D |
| Example 18 | 8.4 | D | 91 | D | 2, 5, 6 | 3 | D | 18 | D |
| Example 19 | 9.1 | D | 95 | D | 1, 3, 5 | 3 | D | 17 | D |
| Example 20 | 9.3 | D | 99 | D | 1, 4, 7 | 3 | D | 17 | D |
| Comparative Example 1 | 9.5 | D | 84 | D | 1, 4, 8 | 3 | D | 10 | E |
| Comparative Example 2 | 8.2 | D | 92 | D | 2, 4, 6, 8 | 4 | E | 8 | E |
| Comparative Example 3 | 8.9 | D | 88 | D | 1, 2, 3, 5, 8 | 5 | E | 8 | E |
| Comparative Example 4 | 8.7 | D | 89 | D | 1, 2, 3, 4, 5, 6, 8 | 7 | E | 6 | E |
| Comparative Example 5 | 9.4 | D | 94 | D | 1, 2, 3, 6, 7, 8 | 6 | E | 6 | E |
| Comparative Example 6 | 9.5 | D | 110 | E | 1, 3, 4, 5, 7 | 5 | E | 4 | E |
| Comparative Example 7 | 8.1 | D | 101 | E | 1, 2, 3, 8 | 4 | E | 4 | E |
| Comparative Example 8 | 10.1 | E | 102 | E | 1, 2, 3, 4, 5, 6, 7 | 7 | E | 2 | E |
| Comparative Example 9 | 10.0 | E | 104 | E | 1, 3, 4, 6, 7, 8 | 6 | E | 2 | E |
| Comparative Example 10 | 10.5 | E | 109 | E | 2, 5, 4, 7 | 4 | E | 2 | E |
| Comparative Example 11 | 10.9 | E | 110 | E | 3, 4, 5, 6, 8 | 5 | E | 2 | E |
| Comparative Example 12 | 10.3 | E | 115 | E | 1, 2, 3, 5, 7 | 5 | E | 2 | E |
| Comparative Example 13 | 10.4 | E | 120 | E | 1, 2, 3, 4, 7 | 5 | E | 2 | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-070601, filed Mar. 31, 2015, which is hereby incorporated by reference herein in its entirety.

What is claimed is:

1. A magnetic carrier, comprising:

a ferrite core particle having magnetism; and a coating resin, wherein:

the coating resin has a surface resin layer, and a resin composition present between the ferrite core particle and the surface resin layer;

the resin composition contains a resin, and at least one selected from the group consisting of an inorganic particle and carbon black that are subjected to a hydrophilic treatment;

the surface resin layer (i) contains a resin, (ii) is free of the inorganic particle or the carbon black that is subjected to the hydrophilic treatment, and (iii) has a thickness in a range of from 0.01 μm or more to 4.00 μm or less; and a moisture percentage change (A-B) between a moisture percentage (A) when the magnetic carrier is left to stand under an environment having a temperature of 30° C. and a humidity of 80% RH for 24 hours, and a moisture percentage (B) when the magnetic carrier is left to stand under an environment having a temperature of 23° C. and a humidity of 5% RH for 24 hours after the standing under the environment having a temperature of 30° C. and a humidity of 80% RH for 24 hours is 0.030 mass % or less.

2. The magnetic carrier according to claim 1, wherein the at least one selected from the group consisting of the inorganic particle and the carbon black that are subjected to the hydrophilic treatment has an ester group and/or a carboxyl group on a surface of a substrate, and a total functional group concentration of the ester group and the carboxyl group is 20% or more.

3. The magnetic carrier according to claim 1, wherein the ferrite core particle is a resin-filled magnetic core having a porous magnetic core particle and a resin filled into a pore of the porous magnetic core particle.

* * * * *